US009101805B2

(12) United States Patent
Stites et al.

(10) Patent No.: US 9,101,805 B2
(45) Date of Patent: Aug. 11, 2015

(54) GOLF CLUBS AND GOLF CLUB HEADS

(71) Applicant: Nike, Inc., Beaverton, OR (US)

(72) Inventors: John T. Stites, Weatherford, TX (US); Chewei Tai, Ping Tung (TW)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/907,430

(22) Filed: May 31, 2013

(65) Prior Publication Data

US 2013/0324284 A1 Dec. 5, 2013

Related U.S. Application Data

(60) Provisional application No. 61/653,639, filed on May 31, 2012.

(51) Int. Cl.

| | |
|---|---|
| ***A63B 53/02*** | (2006.01) |
| ***A63B 53/04*** | (2015.01) |
| *A63B 59/00* | (2015.01) |

(52) U.S. Cl.

CPC ..... *A63B 53/02* (2013.01); *A63B 53/047* (2013.01); *A63B 53/0466* (2013.01); *A63B 59/0088* (2013.01); *A63B 2053/026* (2013.01)

(58) Field of Classification Search

CPC ..... A63B 53/02; A63B 53/04; A63B 53/047
See application file for complete search history.

(56) References Cited

U.S. PATENT DOCUMENTS

| | | | | |
|---|---|---|---|---|
| 1,222,770 A | | 4/1917 | Kaye | |
| 1,983,158 A | | 12/1934 | Young | |
| 2,478,468 A | | 8/1949 | Drake | |
| 2,520,702 A | * | 8/1950 | Verderber | 473/247 |
| D204,001 S | | 3/1966 | Lubin | |
| 3,519,271 A | | 7/1970 | Smith | |
| 3,675,923 A | | 7/1972 | Allen et al. | |
| 3,815,910 A | | 6/1974 | Raines | |
| 3,840,231 A | * | 10/1974 | Moore | 473/245 |
| 3,980,301 A | | 9/1976 | Smith | |
| 4,534,558 A | | 8/1985 | Yoneyama | |
| 4,582,321 A | | 4/1986 | Yoneyama | |
| 4,630,827 A | | 12/1986 | Yoneyama | |
| 4,635,941 A | | 1/1987 | Yoneyama | |
| 4,664,383 A | | 5/1987 | Aizawa | |
| 4,667,963 A | | 5/1987 | Yoneyama | |
| 4,697,814 A | | 10/1987 | Yamada | |
| 4,702,477 A | | 10/1987 | Solomon | |
| 4,708,347 A | | 11/1987 | Kobayashi | |
| 4,722,528 A | | 2/1988 | Tsao | |

(Continued)

FOREIGN PATENT DOCUMENTS

GB 2280380 1/1995

OTHER PUBLICATIONS

ISR and Written Opinion dated Jul. 24, 2013, from PCT Application No. PCT/US2013/043613.

(Continued)

*Primary Examiner* — Michael Dennis
(74) *Attorney, Agent, or Firm* — Banner & Witcoff, Ltd.

(57) ABSTRACT

Golf club heads include a golf club head body, a ball striking face, and a shaft engaging member configured to engage a golf club shaft with the golf club head body. Further, the shaft engaging member may be configured to engage the golf club head body and the shaft below a center of gravity of the golf club head.

27 Claims, 17 Drawing Sheets

(56) References Cited

U.S. PATENT DOCUMENTS

| | | | | | |
|---|---|---|---|---|---|
| 4,728,105 | A | | 3/1988 | Kobayashi | |
| 4,927,144 | A | | 5/1990 | Stormon | |
| 4,988,104 | A | | 1/1991 | Siotani et al. | |
| 5,004,242 | A | | 4/1991 | Iwanaga et al. | |
| 5,009,425 | A | | 4/1991 | Okumoto et al. | |
| 5,078,397 | A | | 1/1992 | Aizawa | |
| 5,133,553 | A | * | 7/1992 | Divnick | 473/245 |
| 5,228,694 | A | | 7/1993 | Okumoto et al. | |
| 5,269,517 | A | | 12/1993 | Petruccelli et al. | |
| 5,326,106 | A | * | 7/1994 | Meyer | 473/305 |
| 5,333,871 | A | | 8/1994 | Wishon | |
| 5,382,019 | A | | 1/1995 | Sneed | |
| 5,413,337 | A | * | 5/1995 | Goodman et al. | 473/247 |
| 5,419,560 | A | | 5/1995 | Bamber | |
| 5,435,551 | A | | 7/1995 | Chen | |
| 5,447,307 | A | | 9/1995 | Antonious | |
| 5,538,245 | A | * | 7/1996 | Moore | 473/239 |
| 5,601,498 | A | | 2/1997 | Antonious | |
| 5,695,409 | A | | 12/1997 | Jackson | |
| 5,695,410 | A | | 12/1997 | Brown | |
| 5,709,613 | A | | 1/1998 | Sheraw | |
| 5,733,203 | A | | 3/1998 | Middleton | |
| 5,749,790 | A | | 5/1998 | Van Alen, II et al. | |
| 5,795,246 | A | | 8/1998 | Hale | |
| 5,816,931 | A | | 10/1998 | Schooler | |
| 6,001,028 | A | | 12/1999 | Tang et al. | |
| 6,048,275 | A | | 4/2000 | Gedeon | |
| 6,080,068 | A | | 6/2000 | Takeda | |
| 6,117,022 | A | | 9/2000 | Crawford et al. | |
| 6,299,546 | B1 | | 10/2001 | Wang | |
| 6,319,146 | B1 | | 11/2001 | Mills | |
| 6,497,626 | B1 | | 12/2002 | Sundberg | |
| 6,506,126 | B1 | * | 1/2003 | Goodman | 473/245 |
| 6,514,154 | B1 | * | 2/2003 | Finn | 473/306 |
| 6,514,155 | B1 | | 2/2003 | Sheets | |
| 6,923,733 | B2 | | 8/2005 | Chen | |
| 7,090,590 | B2 | | 8/2006 | Chen | |
| 7,128,663 | B2 | | 10/2006 | Bamber | |
| 7,297,071 | B2 | | 11/2007 | Hyman | |
| 7,938,739 | B2 | | 5/2011 | Cole et al. | |
| 7,976,400 | B1 | | 7/2011 | Pottorff | |
| 8,070,622 | B2 | | 12/2011 | Schmidt | |
| 8,182,364 | B2 | | 5/2012 | Cole et al. | |
| 2001/0041628 | A1 | | 11/2001 | Thorne et al. | |
| 2010/0261546 | A1 | | 10/2010 | Nicodem | |
| 2012/0077615 | A1 | | 3/2012 | Schmidt | |

OTHER PUBLICATIONS

Feb. 27, 2013—(WO) International Search Report and Written Opinion—App PCT/US2012/067050.

* cited by examiner 607c
607
601
611
607a
629b
609a
612
629a
620
609
628
608
607d
609c
607b
609b 607c
611
607a
607
607d
608
607b
601
609c
609b
609a
609
629b
628
620
629a 601
602
604
607
607a
607c
607d
608
609
609a
609b
609c
612
613
619
620
621
627
628
629
629b 601
607a
607c
611
607
609c
607b
609b
629b
607d
628
612
622
608
609
609a
620
629a 607c
607
611
607a
607b
624
607d
622
608
609b
601
609c
623
609a
629b
628
620
629a
622
609

601
602
604
607
607a
607b
607c
607d
608
609
609a
609b
609c
612
613
620
621
622
623
624
628
629a
629b 701
707c
711
707
707a
712
709a
733
709
709d
722
707b
709b
709c
721
727
731
732
730
733a
709c
722
701

GOLF CLUBS AND GOLF CLUB HEADS

CROSS-REFERENCE TO RELATED APPLICATION

The present application claims priority to, and is a non-provisional of, U.S. Provisional Application No. 61/653,639, filed on May 31, 2012, which application is incorporated herein in its entirety and made a part hereof.

FIELD OF THE DISCLOSURE

The present disclosure relates to golf clubs and golf club heads. Particular example aspects of this disclosure relate to the configuration of golf club heads.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well-known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.). Still other advancements have sought to provide golf club constructions that provide improved feel to the golfer or enhanced energy transfer from the golf club to the golf ball.

While the industry has witnessed dramatic changes and improvements to golf equipment in recent years, there is room in the art for further advances in golf club technology. The present invention seeks to address certain of the shortcomings of prior golf club designs and to provide a design having advantages to heretofore provided.

BRIEF SUMMARY

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf club heads according to at least some example aspects of this disclosure include: a golf club head body, a ball striking face, and a shaft engaging member which is configured to engage the golf club head body with a golf club shaft. According to aspects of the disclosure, the golf club head body and the shaft engaging member may be configured so as to engage with each other. Further, according to aspects of the disclosure, the golf club head may be configured to provide the connection between the golf club head body and the shaft connecting member wherein the connection is below the center of gravity of the golf club head and/or the center of gravity of the golf club head body. Additionally, according to aspects of the disclosure, the golf club head may be configured so as to provide the connection between the golf club head body and the shaft connecting member below the center of the ball striking face of the golf club head or below other preferred impact positions between the golf ball and the ball striking face of the golf club head.

Additional aspects of this disclosure relate to golf club structures that include golf club heads, e.g., of the types described above. Such golf club structures further may include one or more of: a shaft attached to the club head (optionally via a separate shaft connecting member or a shaft connecting member provided as an integral part of one or more of the club head or shaft); a grip or handle attached to the shaft member; additional weight members; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head, by obtaining the golf club head from another source, etc.; and (b) engaging the shaft with the golf club head (e.g., via the shaft connecting member). Other steps also may be included in these methods, such as engaging a grip with the shaft, club head body finishing steps, etc.

BRIEF DESCRIPTION OF THE DRAWINGS

The present disclosure is illustrated by way of example and not limited in the accompanying figures, in which like reference numerals indicate similar elements throughout, and in which.

Figure 1:
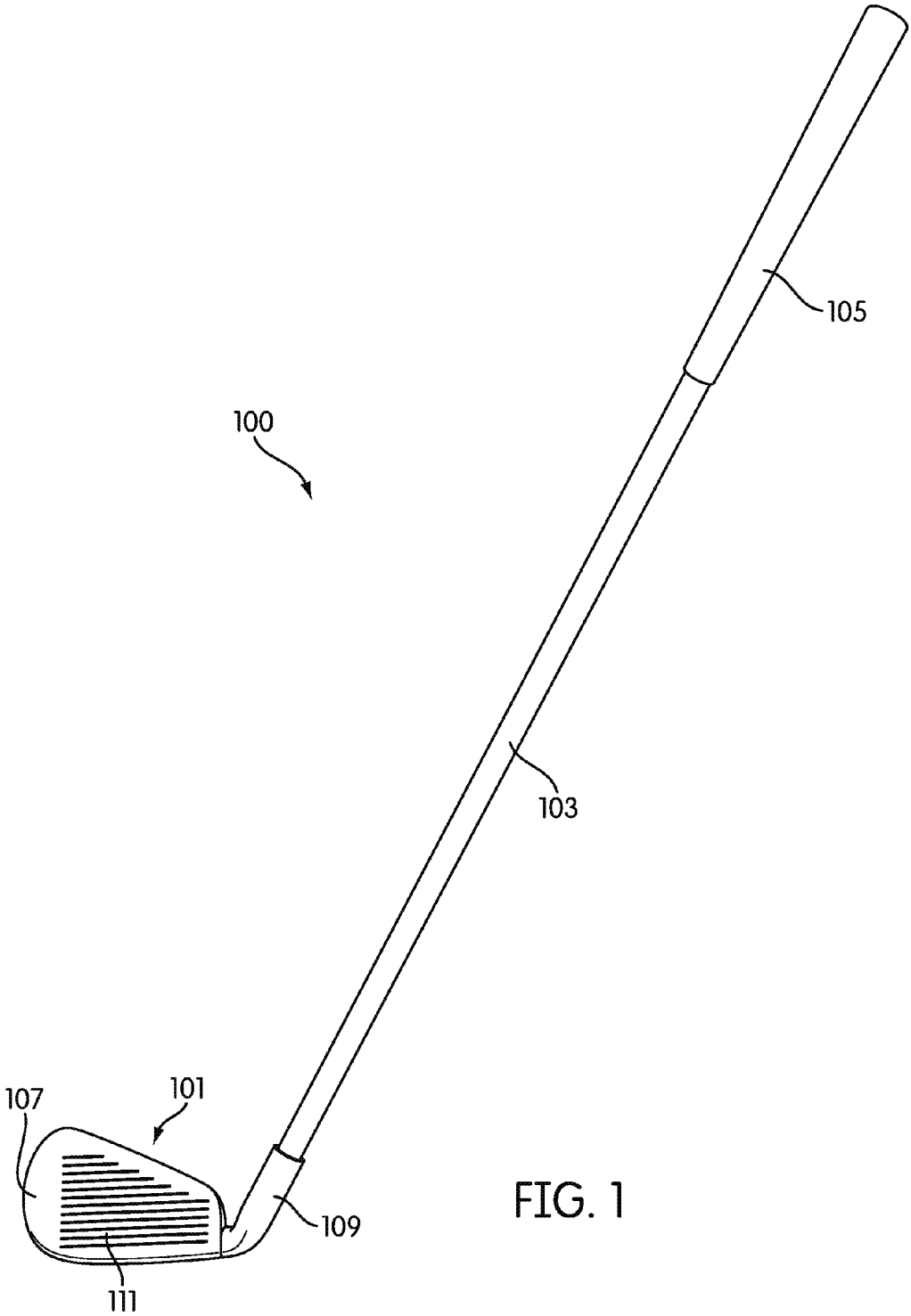
FIG. 1 is an illustrative embodiment of an iron-type golf club structure according to aspects of the disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. General Description of Example Golf Club Heads, Golf Clubs, and Methods in Accordance with this Disclosure Aspects of this disclosure relate to iron-type golf club heads and iron-type golf clubs. Iron-type golf club heads according to at least some example aspects of this disclosure may include: (a) an iron-type golf club head body; (b) a ball striking face; and (c) a shaft engaging member that is configured to engage the iron-type golf club head with a shaft of the iron-type golf club.

According to aspects of this disclosure, the iron-type golf club head body and the shaft engaging member may be integrally formed and/or separate parts configured to engage with each other. Further, according to aspects of the disclosure, the iron-type golf club head body and the shaft engaging member may be configured to provide a connection between the iron-type golf club head body and the shaft engaging member, wherein the entire connection is completely below the center of gravity of the iron-type golf club head and/or the center of gravity of the iron-type golf club head body. Additionally, according to aspects of the disclosure, the iron-type golf club head body and the shaft engaging member may be configured to provide the entire connection between the iron-type golf club head body and the shaft connecting member completely below the center of the ball striking face of the iron-type golf club head or completely below other preferred impact positions between the golf ball and the ball striking face of the iron-type golf club head.

Further aspects of this disclosure relate to wood-type golf club heads and wood-type golf clubs. Wood-type golf club heads according to at least some example aspects of this disclosure may include: (a) a wood-type golf club head body; (b) a ball striking face; and (c) a shaft engaging member that is configured to engage the wood-type golf club head with a shaft of the wood-type golf club.

According to aspects of this disclosure, the wood-type golf club head may be configured such that an entire connection between the wood-type golf club head body and the shaft engaging member is completely below the center of gravity of the wood-type golf club head and/or the center of gravity of the wood-type golf club head body. Additionally, according to aspects of the disclosure, the golf club head may be configured such that the entire connection between the wood-type golf club head body and the shaft engaging member is completely below the center of the ball striking face of the wood-type golf club head or below other preferred impact positions between the golf ball and the ball striking face of the wood-type golf club head.

According to further aspects of the disclosure, golf club heads as described herein may be configured to have rotational locking structure that is configured to permit connection of the shaft engaging member to the club head body in at least first and second different rotational positions (i.e., a plurality of different positions) with respect to each other. The club head body may further be configured so that the loft angle of the club head is different in each different rotational position. Various structures may be used for achieving different rotational positions, such as by using interlocking gear teeth or other complementary engaging structures.

Further, it is noted that, according to aspects of the disclosure, the iron-type or wood-type golf club head body and the shaft engaging member may be separate pieces configured to engage with each other. Additionally, according to other aspects of the disclosure, the iron-type or wood-type golf club head body and the shaft engaging member may be integrally formed as a unitary, one-piece construction.

Additional aspects of this disclosure relate to iron-type and wood-type golf club structures that include golf club heads, e.g., of the types described above. Such iron-type and wood-type golf club structures further may include one or more of: a shaft attached to the golf club head (optionally via a separate shaft engaging member or a shaft engaging member provided as a part of one or more of the club head and/or shaft); a grip or handle attached to the shaft; etc.

Still additional aspects of this disclosure relate to methods for producing iron-type and wood-type golf club heads and iron-type and wood-type golf club structures in accordance with examples of this disclosure. Such methods may include, for example, one or more of the following steps in any desired order and/or combinations: (a) providing a golf club head, e.g., of the various types described above (including any or all of the various structures, features, and/or arrangements described above), e.g., by manufacturing or otherwise constructing the golf club head body, by obtaining it from a third party source, etc.; (b) engaging a shaft with the golf club head (e.g., via the shaft engaging member); and (c) engaging a grip with the shaft.

Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-5A and 6-10A.

FIG. 1 generally illustrates an example of an iron-type golf club 100 according to aspects of the disclosure. As seen in FIG. 1, the iron-type golf club may include an iron-type golf club head 101 in accordance with the present disclosure.

In addition to the golf club head 101, the overall golf club structure 100 may include a shaft 103 and a grip or handle 105 attached to the shaft 103. The shaft 103 may be received in, engaged with, and/or attached to the golf club head 101, for example, through a shaft-receiving sleeve or element extending into the club head 101 (e.g., the shaft engaging member discussed below), via a hosel (e.g., a hosel included in the shaft engaging member discussed below), and/or in other manners as will be described in more detail below. The connections may be via adhesives, cements, welding, soldering, mechanical connectors (such as threads, retaining elements, or the like), etc. If desired, the shaft 103 may be connected to the golf club head 101 in a releasable and/or adjustable manner using mechanical connectors to allow easy interchange of one shaft for another on the head and/or adjustment of the shaft with respect to the head.

The shaft 103 may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle 105 may be attached to, engaged with, and/or extend from the shaft 103 in any suitable or desired manner, including in conventional manners known and used in the art, e.g., using adhesives or cements, mechanical connectors, etc. As another example, if desired, the grip or handle 105 may be integrally formed as a unitary, one-piece construction with the shaft 103. Additionally, any desired grip or handle materials may be used without departing from this disclosure, including, for example: rubber materials, leather materials, rubber or other materials including cord or other fabric material embedded therein, polymeric materials, and the like.

According to aspects of the disclosure, the golf club head 101 may include a golf club head body 107 and a shaft engaging member 109. Further, according to aspects of the disclosure, the golf club head body 101 may also include a ball striking face or striking face 111. In some example structures, the ball striking face 111 may be integrally formed with the golf club head body 107 as a unitary, one-piece construction. According to other examples, the ball striking face 111 may constitute a separate element, such as a face plate, which is configured to be engaged with the golf club head body 107. For example, the golf club head body 107 may include a structure, such as a recess, notch, frame or other configuration for receiving the face plate. According to aspects of the disclosure, the face plate may be engaged with the golf club head body 107 in a variety of ways. For example, the face plate may be engaged with the golf club head body 107 by press fitting; bonding with adhesives or cements; welding (e.g., laser welding), soldering, brazing, or other fusing techniques; mechanical connectors; etc.

According to aspects of the disclosure, the ball striking face 111 may have a generally trapezoidal shape which extends between a top and a sole of the golf club head body 107 and, further, extends substantially between a toe and a heel of the golf club head body 107. Of course, the ball striking face 111 may have other configurations as well.

According to further aspects of the disclosure, the ball striking face 111 may be comprised of one or more materials. The material(s) of the ball striking face should be relatively durable to withstand the repeated impacts with the golf ball. As some more specific examples, the ball striking face 111 may comprise a high strength steel titanium or other metals, or other alloys as well.

Further, according to aspects of the disclosure, the ball striking face 111 may include one or more score lines or grooves that extend generally horizontally across the ball striking face 111 (when the club is oriented in a ball address orientation). The grooves may interact with the dimpled surface of the golf ball during the impact of the golf club head 101 with a golf ball (e.g., during a golf swing) and affect the aerodynamics of the golf ball during the golf shot. For example, the grooves may cause a spin (e.g., back spin) of the golf ball during the golf shot.

Figure 2:
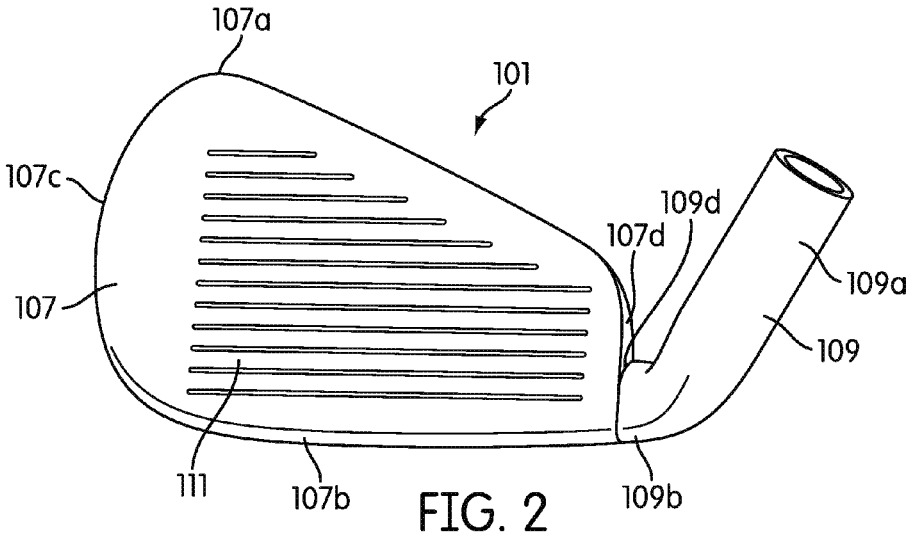
FIG. 2 is an enlarged view of the iron-type golf club head shown in FIG. 1.
Figure 3:
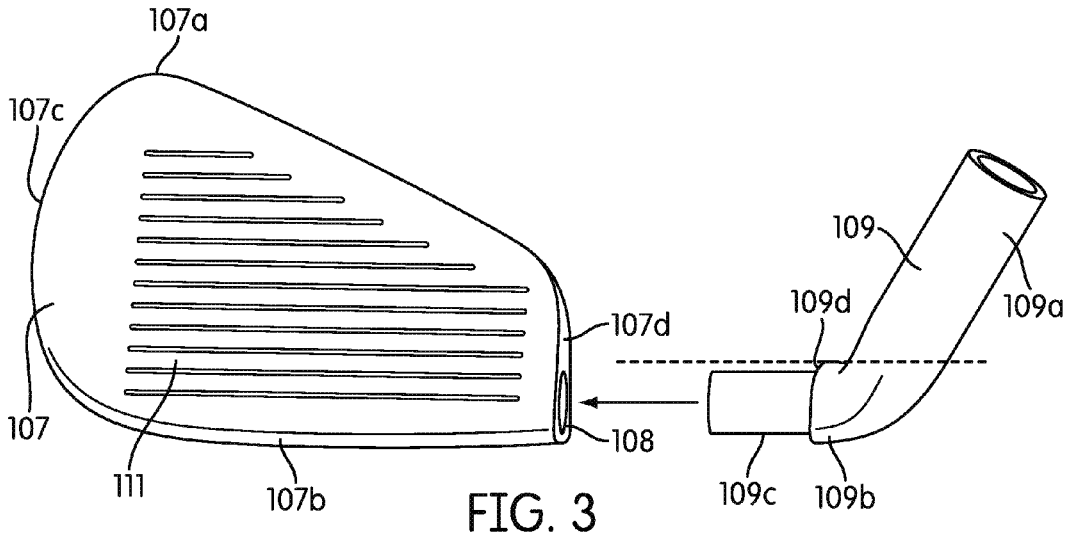
FIG. 3 is an exploded view of the iron-type golf club head shown in FIG. 2.

Aspects of the disclosure relate to particular structures of the golf club head body 107 and the shaft engaging member 109. According to some examples of this invention, the golf club head body 107 and the shaft engaging member 109 may be separate pieces that are configured to be engaged with each other. FIGS. 2-3 illustrate various views of a golf club head 101 according to such an embodiment of this disclosure. Specifically, FIG. 2 is a front view of an illustrative embodiment of the golf club head 101 according to aspects of the disclosure and FIG. 3 is an exploded view of the embodiment of the golf club head 101 shown in FIG. 2. It is understood that the shaft engaging member 109 may be integrally formed with or otherwise connected to the body 107 in some embodiments, such as a conventional hosel structure.

According to aspects of the disclosure, the golf club head body 107 may be constructed in any suitable or desired manner and/or from any suitable or desired materials without departing from this disclosure, including from conventional materials and/or in conventional manners known and used in the art. For example, the club head body 107 and/or its various parts may be made by forging, casting, molding, and/or using other techniques and processes, including techniques and processes that are conventional and known in the art. According to aspects of the disclosure, the golf club head body 107 may be a blade type iron golf club head. According to other aspects the golf club head body 107 may be a perimeter weighted and/or cavity back type golf club head, a half cavity iron type golf club head, or other iron type golf club head structure.

According to aspects of the disclosure, the golf club head body 107 may include a top 107*a*, a sole 107*b*, a toe end 107*c*, and a heel end 107*d*. Further, as seen in FIGS. 2 and 3, according to aspects of the disclosure, the golf club head body 107 may be configured in a generally trapezoidal shape.

According to aspects of the disclosure, at least a portion of the heel end 107*d* of the golf club head body 107 may be substantially flat. For example, at least a portion of the heel end 107*d* of the golf club head body 107 may formed as a relatively flat surface that extends in a plane substantially perpendicular to the sole 107*b* of the golf club head body 107 (e.g., the heel end 107*d* may extend in a substantially vertical plane when the golf club head 101 is at the ball address position). Further, according to aspects of the disclosure and as seen in FIG. 3, the heel end 107*d* may have a tapered configuration wherein the heel end 107*d* becomes narrower as it extends vertically upward from the sole 107*b*, such that the lower portion of the heel end 107*d* is wider than the upper portion of the heel end 107*d*.

According to aspects of the disclosure, the golf club head body 107 may be configured to engage with the shaft engaging member 109. For example, as shown in FIG. 3, the golf club head body 107 may include a connecting structure, such as a hole 108, configured to receive a portion of the shaft engaging member 109. According to aspects of the disclosure, the hole 108 may be provided in the golf club head body 107 in a variety of ways. For example, the hole 108 may be bored or otherwise created in a machining method, or may be created in an extrusion method. Also, the hole 108 may be formed in the golf club head body 107 during manufacturing, such as when the golf club head body 107 is created by forging, casting, molding, and/or other techniques and processes.

According to aspects of the disclosure, the hole 108 may be formed in a side of the golf club head body 107 which is configured to engage with the shaft engaging member 109. For example, the hole 108 may be positioned in the heel end 107*d* of the golf club head body 107. Such an illustrative embodiment is shown in FIGS. 2-3. As seen in FIGS. 2-3, the hole 108 extends from the plane formed from the flat surface at the heel end 107*d* of the golf club head body 107 into the golf club head body 107. According to aspects of the disclosure, the hole 108 may extend between 0.2-1.0 inches, 0.4-0.8 inches or 0.5-0.6 inches into the golf club head body 107. If desired, the hole 108 may be tapered so that the diameter becomes narrower as it extends farther into the golf club head body 107. As long as the shaft engaging member 109 and the golf club head body 107 are securely engaged, the distance or depth into the golf club head body 107 which the hole 108 extends may be varied as desired. For example, in some embodiments of the disclosure, the hole 108 may extend into the golf club head body 107 across substantially the entire length of the golf club head body 107 or the entire length of the length of the sole of the golf club head body 107. In other words, the hole 108 may extend into the golf club head body 107 over 60%, 70%, 80%, 90% or 95% of the length of the of the golf club head body 107 or 60%, 70%, 80%, 90% or 95% of the length of the length of the sole of the golf club head body 107.

According to aspects of the disclosure, the width (e.g., the diameter) at the opening of hole 108 may be varied as desired. According to some aspects of the disclosure, the opening of the hole 108 may have a width of 0.25-0.75 inches, 0.4-0.6 inches or 0.5-0.55 inches. Further, the opening of the hole 108 may be in a range of 20-70%, 30-60% or 40-50% of a total surface area of the heel end 107*d* of the golf club head body 107. According to aspects of the disclosure, the shape of the opening of the hole 108 may be configured as desired. For example, the shape of the opening of the hole 108 may be circular, triangular, square or rectangular, other polygons, serrated, etc. The shaft engaging member 109 may be configured in a complementary structure so that the shaft engaging member 109 may be rotationally locked with respect to the body 107. For example, in one embodiment, the hole 108 and the shaft engaging member 109 may have a plurality of interlocking gear teeth, such as in the embodiment shown in FIGS. 13-14, described below. Further, while only a single hole is shown in the depicted embodiment, multiple holes may be provided and used if desired.

According to aspects of the disclosure, the hole 108 may be configured as a horizontal, or relatively horizontal, hole in the golf club head body 107 (when the club head 101 is in a ball address orientation). For example, as seen in the depicted embodiment, the hole 108 extends in a horizontal fashion in the toe-heel direction of the golf club head body 107. However, if desired, the hole 108 may be configured to create an angled hole in the golf club head body 107. For example, the hole 108 may be angled upwardly or downwardly relative to the heel to toe direction for the golf club head 107.

According to aspects of the disclosure, the hole 108 may be positioned relatively low in the golf club head body 107 when the club head 101 is in a ball address orientation. For example, the hole 108 may be positioned closer to sole 107*b* of the golf club head body 107 than the top 107*a* of the golf club head body 107. As some more specific examples, the hole 108 may be positioned such that it is in the lower half, lower third, or lower quarter of an overall height, of the golf club head body 107 (e.g., as measured from the sole to the highest point of the golf club head body 107 when the when the club head 101 is in a ball address orientation). Further, according to aspects of the disclosure, the hole 108 may be positioned such that it is just above the sole 107*b* of the club head body 107 (e.g., the lower edge of the hole 108 may be within approximately 0.125 to 0.25 inches above the sole 107*b* of the golf club head body 107).

As discussed above, the golf club head 101 may include a shaft engaging member 109. The shaft engaging member may 109 may be configured to receive the shaft 103 and, further, to engage the golf club head body 107. According to aspects of the disclosure, and the shaft engaging member 109 may be constructed in any suitable or desired manner and/or from any suitable or desired materials without departing from this disclosure, including from conventional materials and/or in conventional manners known and used in the art for making golf club heads and parts of golf club heads. For example, according to aspects of the disclosure, similarly to the golf club head body 107, the shaft engaging member 109 may be formed in a variety of ways, such as forging, casting, molding, and/or other techniques and processes and may be made from durable materials, such as metals (e.g., steel, alloys, etc.) plastics, polymers, etc. Further, as seen in FIGS. 2-3, according to aspects of the disclosure, the shaft engaging member 109 may include a first portion 109*a* configured to engage with the shaft 103 of the golf club and a second portion 109*b* configured to engage with the club head body 107.

According to aspects of the disclosure, the first portion 109*a* may be oriented so that it extends upward and away from the golf club head body 107 when engaged with the golf club head body 107 and the golf club 100 is at the ball address position. In this configuration, the first portion 109*a* may be considered to be in the form of an upwardly extending leg. Further, according to aspects of the disclosure, the first portion 109*a* of the shaft engaging member 109 may include a hosel or other structure for engaging the shaft. According to aspects of the disclosure, the shaft 103 may be received in and/or inserted into and/or through the hosel.

If desired, the first portion 109*a* of the shaft engaging member 109 may be configured such that the shaft 103 may be engaged with the first portion 109*a* of the shaft engaging member 109 in a releasable and/or adjustable manner using mechanical connectors to allow easy interchange of one shaft for another on the head and/or to allow adjustment of the orientation of the shaft 103 with respect to the golf club head 107. For example, threads, locking mechanisms, etc. may be incorporated into the first portion 109*a* of the shaft engaging member 109, and the end of the shaft 103 that is to be engaged with the first portion 109*a* of the shaft engaging member 109 may be configured with a corresponding configuration. Alternatively, the shaft 103 may be secured to the shaft connecting member 109 via bonding with adhesives or cements, welding (e.g., laser welding), soldering, brazing, or other fusing techniques, etc.

Further, optionally, if desired, the hosel may be eliminated and the shaft 103 may be otherwise attached to the golf club head 101 through the first portion 109*a* of the shaft engaging member 109 of the golf club head 101. For example, the shaft 103 may be otherwise engaged with the first portion 109*a* of the shaft engaging member 109 by butt welding, laser welding, other type of welding; bonding with adhesives or cements, soldering, brazing, or other fusing techniques; etc.

As discussed above, according to aspects of the disclosure, the shaft engaging member 109 may include a second portion 109*b* that is configured to engage with the club head body 107. As seen in FIG. 2, according to aspects of the disclosure, the second portion 109*b* may be oriented so that it extends horizontally, or relatively horizontally, when engaged with the golf club head body 107 and the golf club 100 is at the ball address position. If desired, the shaft engaging member 109 may be configured such that an obtuse angle is defined between the first portion 109*a* of the shaft engaging member 109 and the second portion 109*b* of the shaft engaging member 109. The juncture formed between the second portion of the shaft connecting member 109*b* and the first portion of the shaft connecting member 109*a* may define the top of the second portion of the shaft connecting member 109*b*. In such embodiments, the second portion of the shaft connecting member 109*b* is considered to not extend above the horizontal, or relatively horizontal, line (when the club head 101 is at the ball address position) that defines, in part, the angle formed between the second portion of the shaft connecting member 109*b* and the first portion of the shaft connecting member 109*a*. FIG. 3 illustrates such a line in broken line format.

Further, as shown in FIG. 2, according to aspects of the disclosure, the second portion 109*b* of the shaft engaging member 109 may be configured with an outer surface that aligns with a corresponding outer surface of the golf club head body 107. For example, the second portion 109*b* of the shaft engaging member 109 may be configured with a shoulder area 109*d* such that the front surface of the shoulder area 109*d* aligns with the front surface, or ball striking face 111, of the golf club head 101 when shaft engaging member 109 is engaged with the golf club head body 107. Similarly, the second portion 109*b* of the shaft engaging member 109 may be configured such that the bottom surface and rear surface of the shoulder area 109*d* align with a respective sole surface and rear surface of the golf club head body 107 when shaft engaging member 109 is engaged with the golf club head body 107. In this way there may be a relatively seamless engagement between the shaft engaging member 109 and the golf club head body 107 (at least along a portion or a majority of the engaged surfaces) when shaft engaging member 109 is engaged with the golf club head body 107. Optionally, the seam between the golf club body 107 and the shaft engaging member 109 may be concealed, e.g., by paint, by chroming or electroplating, by coating, or in some other manner.

According to aspects of the disclosure, the second portion 109*b* of the shaft engaging member 109 may be configured such that the top of the second portion 109*b* does not engage with the top of the golf club head body 107. For example, according to aspects of the disclosure, when engaged with the golf club head body 107, the top of the shoulder area 109*d* of the second portion 109*b* of the shaft engaging member 109 may be at a position that is less than ¾ of the height of the heel end 107*d* of the golf club head body 107 or less than ¾ of the height of the overall golf club head body 107. Further, according to aspects of the disclosure, when engaged with the golf club head body 107, the top of the shoulder area 109*d* of the second portion 109*b* of the shaft engaging member 109 may be at a position that is less than ½ or ¼ of the height of the heel end 107*d* of the golf club head body 107.

Therefore, as seen in FIG. 2, in such a configuration, a space or gap is provided between heel end 107*d* of the golf club head body 107 and the shaft engaging member 109. For example, according to aspects of the disclosure, the golf club head body 107 and the shaft engaging member 109 may be configured to provide a space or gap between the upper portion (e.g., the upper ¾, ½, ¼, etc.) of the heel end 107*d* of club head body 107 (or the upper portion (e.g., the upper ¾, ½, ¼, etc.) of the club head body 107*d*) and the shaft engaging member 109 when the shaft engaging member 109 is engaged with the club head body 107. In this configuration, as seen in FIG. 2, the lower portion of the plane of the heel end 107*d* may be engaged with the shaft engaging member 109 while an upper portion of the vertical plane of the heel end 107*d* (e.g., the upper ¾, ½, ¼, etc.) is exposed and not engaged with the shaft engaging member 109.

According to aspects of the disclosure, the second portion 109*b* of the shaft engaging member 109 may be configured such that when engaged with the golf club head body 107, the connection between the shaft engaging member 109 and the golf club head body 107 (e.g., the second portion 109*b* of the shaft engaging member 109) is below the center of gravity of the iron-type golf club head 101 and/or below the center of gravity of the iron-type golf club head body 107 and/or below the geometric center of the ball striking face 111 of the iron-type golf club head. For example, according to aspects of the disclosure, the second portion 109*b* of the shaft engaging member 109 may be configured such that when engaged with the golf club head body 107, the entire second portion 109*b* of the shaft engaging member 109 (e.g., the entire protrusion 109*c*) is below the center of gravity of the iron-type golf club head 101 and/or below the center of gravity of the iron-type golf club head body 107 and/or below the center of the ball striking face of the iron-type golf club head. Similarly, the body 107 may be configured such that the entire connecting structure of the body 107 (e.g., the hole 108 in one embodiment) is located below the center of gravity of the head 101 and/or below the center of gravity of the body 107 and/or below the geometric center of the ball striking face 111 of the iron-type golf club head.

According to aspects of the disclosure, the second portion 109*b* may include a protrusion 109*c* that extends from the second portion 109*b*. According to aspects of the disclosure, the protrusion 109*c* may extend from a side of the second portion 109*b* of the shaft engaging member 109. As seen in FIG. 3, the protrusion 109*c* may extend outward from a relatively vertical plane formed at the side of the second portion 109*b* of the shaft engaging member 109. In one embodiment, the protrusion 109*c* may form the entirety or substantial entirety of the second portion 109*b* of the shaft engaging member 109.

Further, the protrusion 109*c* may be configured to extend into and engage with and/or be received in the connecting structure of the club head body member 107, such as the hole 108 in FIGS. 2-3. For example, the protrusion 109*c* may be a tubular protrusion and fits into the hole 108 of the club head body member 107. Further, the protrusion 109*c* may be sized and configured such that when engaged with the hole 108, an outer surface of the second portion 109*b* of the shaft engaging member 109 (i.e., the shoulder area 109*d* shown in FIG. 3) matches and mates with a corresponding outer surface of the golf club head body 107 (e.g., in a relatively seamless manner such as described above). Thus, the protrusion 109*c* and the hole 108 may have various corresponding or cooperating shapes.

According to aspects of the disclosure, the protrusion 109*c* may be configured in a variety of ways. For example, the protrusion 109*c* may be formed on the shaft engaging member 109 during manufacturing, such as when the shaft engaging member 109 is created by forging, casting, molding, and/or other techniques and processes. Also, the protrusion 109*c* may be attached to the shaft engaging member 109 after manufacture of the shaft engaging member 109. For example, according to aspects of the disclosure, protrusion 109*c* may be a separate peg or dowel that is engaged with the shaft engaging member 109 (e.g., by welding, by cements, etc.).

According to aspects of the disclosure, the protrusion 109*c* may extend between 0.2-1.0 inches, 0.4-0.8 inches or 0.5-0.6 inches away from the shoulder area 109*d* of the second portion 109*b* of the shaft engaging member 109. As long as the shaft engaging member 109 and the golf club head body 107 are securely engaged, the distance or depth that the protrusion 109*c* extends out of the shaft engaging member 109 may be varied as desired. For example, in some embodiments of the disclosure, the protrusion 109*c* may extend out of the shaft engaging member 109 for a length that is substantially the entire length of the golf club head body 107. In other words, the protrusion 109*c* may extend out of the shaft engaging member 109 over 60%, 70%, 80%, 90% or 95% of the length of the of the golf club head body 107 or the 60%, 70%, 80%, 90% or 95% of the length of the sole of the golf club head body 107. In this way, the protrusion 109*c* may engage with and fill a corresponding hole 108 that extends into the golf club head body 107 by the same or similar dimension.

Figure 3A:
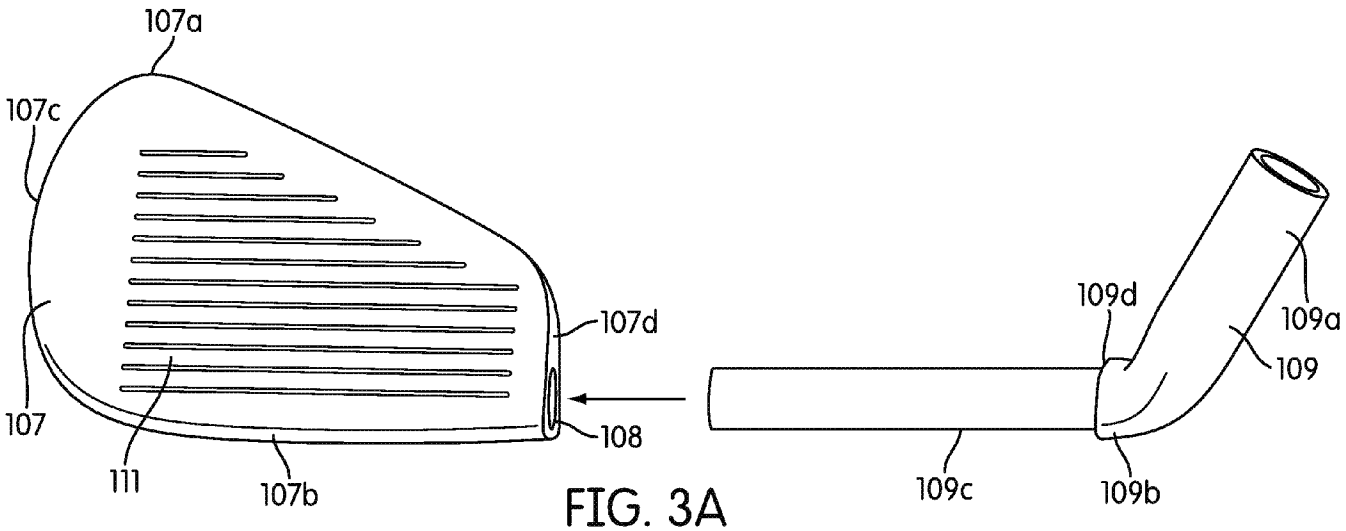
FIG. 3A is an illustrative embodiment of another iron-type golf club structure according to aspects of the disclosure.
Figure 3B:
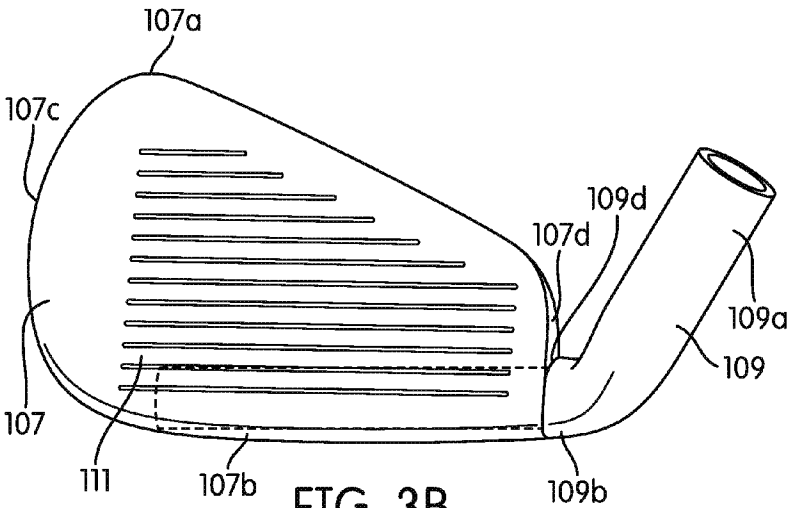
FIG. 3B is an exploded view of the iron-type golf club head shown in FIG. 3A.

FIGS. 3A and 3B shows an illustrative embodiment of the disclosure, wherein the hole 108 and the protrusion 109*c* have lengths which extend substantially the entire length of the golf club head body 107. It is noted that in such an embodiment, the weight of the golf club head 101 may be more centered. Further, the protrusions 109*c* may be formed with a varied density along its length such that the protrusions may provide more weight a particular portion of the golf club head 101 (e.g., heel or toe weighted).

According to further aspects of the disclosure, the width (e.g., the diameter) of the protrusion 109*c* may be varied as desired. According to some aspects of the disclosure, the protrusion 109*c* may have a width of 0.25-0.75 inches, 0.4-0.6 inches or 0.5-0.55 inches. According to aspects of the disclosure, the shape of the protrusion 109*c* may be configured as desired. For example, the shape of the protrusion 109*c* may be circular, triangular, square or rectangular, etc. in order to correspond to the shape of the hole 108 in the golf club head body 107. It is noted that while only a single protrusion 109*c* is shown in the depicted embodiment, multiple protrusions may be used if desired. As mentioned above, the protrusion 109*c* may be configured in a complementary structure so that the shaft engaging member 109 may be rotationally locked with respect to the body 107. For example, in one embodiment, the hole 108 and the protrusion 109*c* may have a plurality of interlocking gear teeth, such as in the embodiment shown in FIGS. 13-14, described below. Other rotational locking structure may be used in other embodiments. Generally, the hole 108 and the protrusion 109*c* may have nearly identical, symmetrical, non-circular cross-sectional shapes that can engage in a plurality of positions. For example, the hole 108 and the protrusion 109*c* may have identical polygonal shapes, such as shapes having a large number of sides to provide a large number of different locking positions. Further rotational locking structures are contemplated.

According to aspects of the disclosure, the protrusion 109*c* may be configured to extend horizontally, or relatively horizontally, away from the shoulder area 109*d* of the shaft engaging mechanism 109. For example, as seen in the depicted embodiment, the protrusion 109*c* extends in a horizontal fashion in the toe-heel direction of the golf club head 101. However, if desired, the protrusion 109*c* may be configured to extend from the shaft engaging member 109 at an angle. For example, the protrusion 109*c* may be angled upwardly or downwardly relative to the heel to toe direction of the shaft engaging member 109.

According to aspects of the disclosure, the protrusion 109*c* may be positioned relatively low in the shaft engaging member 109. For example, the protrusion 109*c* may be positioned closer to the bottom of the shaft engaging member 109 than the top of the shaft engaging member 109. As some more specific examples, the protrusion 109*c* may be positioned such that it is in the lower half, or lower quarter, of the shaft engaging member 109. Further, according to aspects of the disclosure, the protrusion 109*c* may be positioned such that it is extends from the center of the second portion 109*b* of the shaft engaging member 109 (e.g., the lower edge of the protrusion 109*c* may be within approximately 0.125 to 0.25 inches of the bottom of the shaft engaging member 109).

In the depicted embodiment as described above, the shaft engaging member 109 may be engaged with the golf club head body 107 by inserting the protrusion 109*c* into the hole 108. Further, if desired, the golf club head 101 may include one or more securing or retaining features that aid in securing the engagement of the shaft engaging member 109 with the golf club head body 107.

For example, according to aspects of the disclosure, the protrusion 109*c* may include one or more keys or ridges that correspond to one or more respective notches at the opening of the hole 108 or within the interior of the of club head body 107. Such keys or ridges on the protrusion 109*c* may be configured to engage with corresponding notches or grooves in the hole 108 in order to engage or lock the club head body 107 with the shaft engaging member 109 (e.g., to prevent twisting of these parts with respect to one another). For example, the keys or ridges of the protrusion 109*c* may be aligned with notches in the hole 108 to allow the protrusion 109*c* to slide into the hole 108. Further, the hole 108 may be configured with grooves that allow the protrusion 109*c* to be rotated from a first position, at which the keys or ridges are aligned with the notches to allow entry of the protrusion 109*c* into the hole 108, to a second position, wherein the keys or ridges of the protrusion 109*c* are no longer aligned with the notches of the hole 108. In this way, the shaft engaging member 109 may be secured or locked within the golf club head body 107. Of course, other securing or retaining features may be provided as well (e.g., threads, recesses, snap fit features, etc.). For example, the end of hole 108 (e.g., the end of the hole close to the toe of the golf club head 101) may include securing, retaining of locking members (e.g., mechanical connectors) which receive corresponding members on the protrusion 109*c* (e.g., expandable/contractible members on the tip end of the protrusion 109*c*) when the protrusion 109*c* is inserted into the hole 108 and prevent the protrusion 109*c* from being disengaged from the hole 108 once the expandable/contractible members on the tip end of the protrusion 109*c* have been received and expanded in the securing, retaining or locking members at the end of the hole 108 and until they are contracted to release from the mechanical connectors.

According to example embodiments of the disclosure, the hole 108 may extend through the entire golf club head body 107. In such an embodiments, there are openings at both the toe end 107*c* and the heel end 107*d* of the golf club head body 107. Further, in such embodiments, the protrusion 109 may be secured via a mechanical connector extends from the opening at the toe end 107*c* of the golf club head body 107.

Therefore, it is understood that the shaft engaging member 109 may be configured to be engaged with the golf club head body 107 in a releasable manner using mechanical connectors. It is noted that in such a configuration, if desired, easy interchange of one shaft for another (e.g., if the shaft 103 is permanently affixed to the shaft engaging member 109) may be accomplished. Further, it is noted that in addition to the above described mechanical connectors, the engagement between the shaft engaging member 109 the golf club head body 107 may be supplemented with other securing means such as bonding with adhesives or cements, welding (e.g., laser welding), soldering, brazing, or other fusing techniques, etc.

Further, it is noted that while a hole and a protrusion are specifically described above, the shaft engaging member 109 may be engaged with the golf club head body 107 in any desired manner. For example, according to other embodiments of the disclosure, no protrusions and no holes are used. For example, the shaft engaging member 109 may be engaged with the golf club head body 107 via mechanical connectors (e.g., threads, recesses, snap fit features, etc.) which do not include the protrusion and hole described above. Also, if desired, in addition to such other mechanical connectors, the engagement between the shaft engaging member 109 and the golf club head body 107 may be supplemented with other securing means, such as bonding with adhesives or cements, welding (e.g., laser welding), soldering, brazing, or other fusing techniques, etc.

Further, it is noted that as an alternative to mechanical connectors, such as described above, securing means, such as bonding with adhesives or cements, welding (e.g., laser welding), soldering, brazing, or other fusing techniques, etc., may be employed to secure the shaft engaging member 109 with the golf club head body 107. For example, according to some aspects of the disclosure, the second portion 109*b* of the shaft engaging member 109 may be directly engaged with the golf club head body 107. For example, an outer surface of the second portion 109*b* of the shaft engaging member 109 (e.g., the relatively vertical plane at a toe end of the shaft engaging member 109) may be directly engaged with a corresponding outer surface of the club head body 107 (e.g., the relatively vertical plane at the heel end 107*d* of the club head body 107). For example, according to aspects of the disclosure, such portions of the shaft engaging member 109 and the club head body 107 may be engaged via a butt welding process.

In one embodiment, the body 107 and the shaft engaging member 109 may include complementary rotational locking structure that rotationally locks the body 107 and the shaft engaging member 109 together. In another embodiment, such rotational locking structure may be configured for rotationally locking the body 107 and the shaft engaging member 109 in a plurality of different positions, and the loft angle of the club head 101 changes for the plurality of different positions. These multiple different positions and loft angles are illustrated in FIG. 15 and described in greater detail below. For example, the rotational locking structure may be connectable in at least a first position and a second position, where the club head 101 has a first loft angle and a second loft angle, respectively. In a further embodiment, the rotational locking structure may be releasable and reconnectable, in order to allow the rotational orientations of the body 107 and the shaft engaging member 109 and/or the loft angle of the club head 101 to be adjusted. In one example embodiment, such as shown in FIGS. 13-14 described in greater detail below, both the protrusion 109*c* and the hole 108 may have complementary interlocking gear teeth or other interlocking structure for such rotational locking.

It is noted that the shaft engaging member 109 and club head body 107 may have other configurations than shown in the depicted embodiment. For example, golf club head body 107 and shaft engaging member 109 may have corresponding configurations, such as corresponding notches and recesses, corresponding stair step configurations, etc.

Further, it is also noted that, if desired, according to other aspects of the disclosure, the shaft engaging member 109 may be integral with the shaft 103. For example, the shaft 103 may be relatively permanently engaged with the shaft engaging member 109 instead of the shaft 103 being easily removable from the shaft engaging member 109 as described above.

Further, it is also noted that, if desired, according to other aspects of the disclosure, no shaft engaging member 109 is needed. For example, the shaft 103 may be attached directly to the golf club head body 109 or the golf club head 101. For example, the shaft 103 may be configured at its end that is opposite the grip 105 with a configuration to directly engage with the golf club head body 109 or the golf club head 101. For example, the shaft 103 may include a thicker portion that is joined with the golf club head body 109 or the golf club head 101 via mechanical connectors, bonding with adhesives or cements, welding (e.g., laser welding), soldering, brazing, or other fusing techniques, etc. (e.g., joined such that the entire connection is completely below the center of gravity of the golf club head and/or the center of gravity of the iron-type golf club head body and/or the center of the face of the golf club head).

Figure 4:
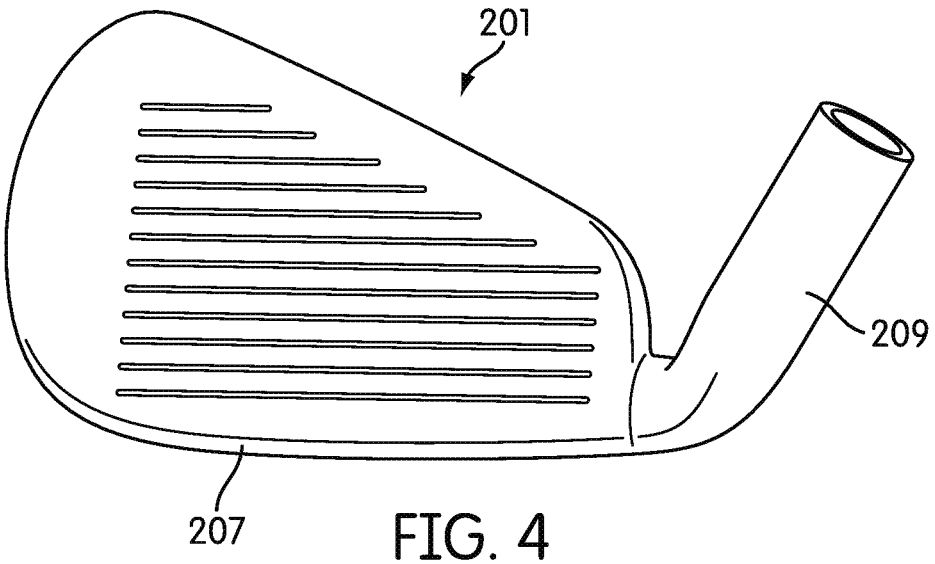
FIG. 4 is an illustrative embodiment of another iron-type golf club structure according to aspects of the disclosure.

Additionally, it is noted that while the above described embodiments reference a shaft engaging member 109 that is a separate element that is configured to be engaged with the golf club head body 107, according to other aspects of the disclosure, the shaft engaging member 109 may be integral with the golf club head body 107. For example, the golf club head 101 may be formed as a single integral piece. An illustrative embodiment of such a golf club head 201 according to such aspects of the disclosure is shown in FIG. 4. The features of the golf club head 201 are similar to the embodiments described above and, therefore, will not be discussed in more detail here for the sake of brevity.

However, it is noted that golf club head 201 may be primarily, or solely, a single integral, piece which includes the golf club head body 207 and the shaft engaging member 209. For example, the club head 201 may be made by forging, casting, molding, and/or using other techniques and processes, including techniques and processes that are conventional and known in the art. The golf club head 201 also may be constructed in any other suitable or desired manner and/or from any suitable or desired materials without departing from this disclosure, including from conventional materials and/or in conventional manners known and used in the art.

Further, it is noted that in the embodiment depicted in FIG. 4, similarly to the embodiments of FIGS. 1-3B, the entire connection between the golf club head body 207 and the shaft engaging member 209 is located below the center of gravity of the iron-type golf club head 201 and/or below the center of gravity of the iron type golf club head body 207. Additionally, the embodiment depicted in FIG. 4 may allow for the entire connection between the golf club head body 207 and the shaft engaging member 209 to be below the center of the ball striking face of the iron-type golf club head 201.

Figure 5A:
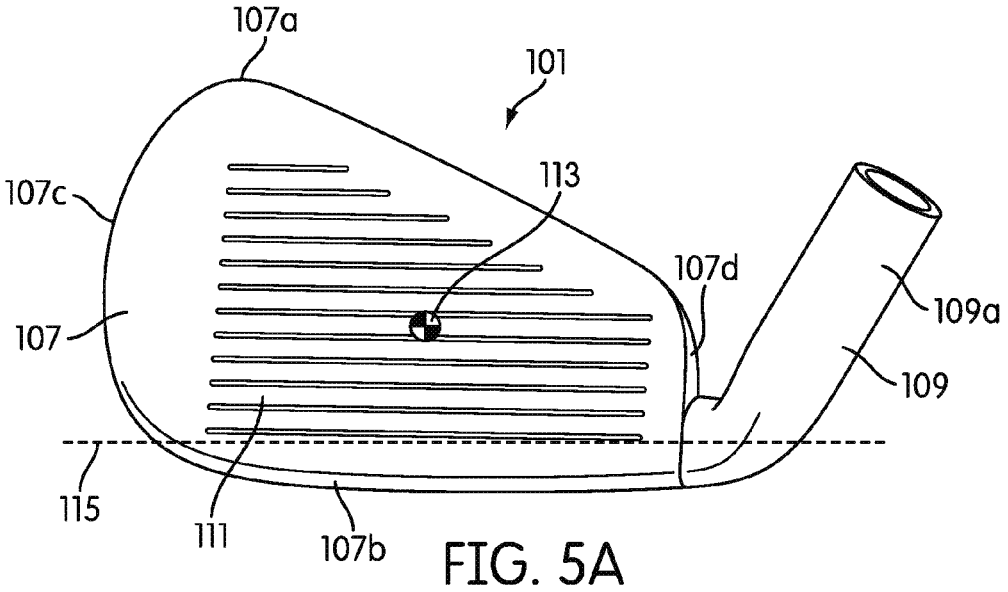
FIG. 5A is another view of the golf club head shown in FIG. 1 wherein the center of gravity of the golf club head is symbolically illustrated.

For example, FIG. 5A illustrates the golf club head 101 wherein the center of gravity of the golf club head 101 is shown symbolically at reference numeral 113. Further, the axis along which the golf club head body 107 and the shaft engaging member 109 are connected is shown symbolically at reference numeral 115. As seen in FIG. 5A, the entire connection between the golf club head body 107 and the shaft engaging member 109 is below the center of gravity 113 of the iron-type golf club head 101 (when the club head is oriented in a ball address position).

Figure 5B:
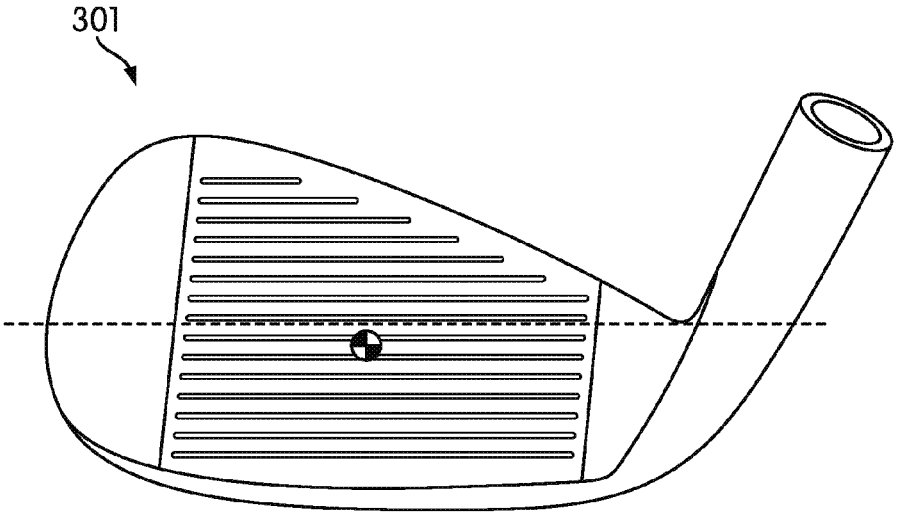
FIG. 5B PRIOR ART
FIG. 5B is a conventional iron-type golf club head wherein the center of gravity of the golf club head is symbolically illustrated.

In contrast, FIG. 5B illustrates a conventional iron-type golf club head 301. As seen in FIG. 5B, the golf club head 301 is a single integral piece wherein the hosel portion of the golf club head 301 is integral with the remainder of the golf club head 301 along the entire heel portion of the golf club head 301. Hence, in contrast to the example golf club head 101 construction shown in FIGS. 1-4, golf club head 301 does not have an entire connection between the golf club head body and the shaft engaging member below the center of gravity of the golf club head.

An iron-type golf club head configured according to aspects of the disclosure can be particularly advantageous. For example, as will be described in detail below, positioning the connection between the golf club head body and the shaft engaging member below the center of gravity of the golf club head and/or the center of gravity of the golf club head body and below the preferred impact position between the golf ball and the ball striking face, may act to provide increased energy transfer.

Further, as will be described in detail below, positioning the connection between the golf club head body and the shaft engaging member below the center of gravity of the golf club head and/or the center of gravity of the golf club head body and below the preferred impact position between the golf ball and the ball striking face, may act to increase "feel" of the golf club, or provide better frequencies of feel to the golfer.

A wide variety of overall club head constructions are possible without departing from this disclosure. For example, it is noted that the dimensions and/or other characteristics of the golf club heads 101 and 201 according to examples of this disclosure may vary significantly without departing from the disclosure. For example, the above described features and configurations may be incorporated into any iron-type club heads including, for example: wedges (e.g., pitching wedges, lob wedges, gap wedges, sand wedges, etc.), iron-type hybrid clubs, driving irons, 0 through 10 irons, etc.

Further, the above described features and configurations in the aspects of the disclosure may be incorporated into blade type golf club heads, perimeter weighted and/or cavity back type golf club heads or other iron type golf club head structures. For example, perimeter weighted and/or cavity back iron-type golf club heads including the golf club head body 107 according to aspects of the disclosure, may include a rear surface opposite the ball striking face 111 that includes a perimeter weighting member extending rearward from the ball striking face and along at least a portion of a circumferential area of the golf club head body.

Figure 6:
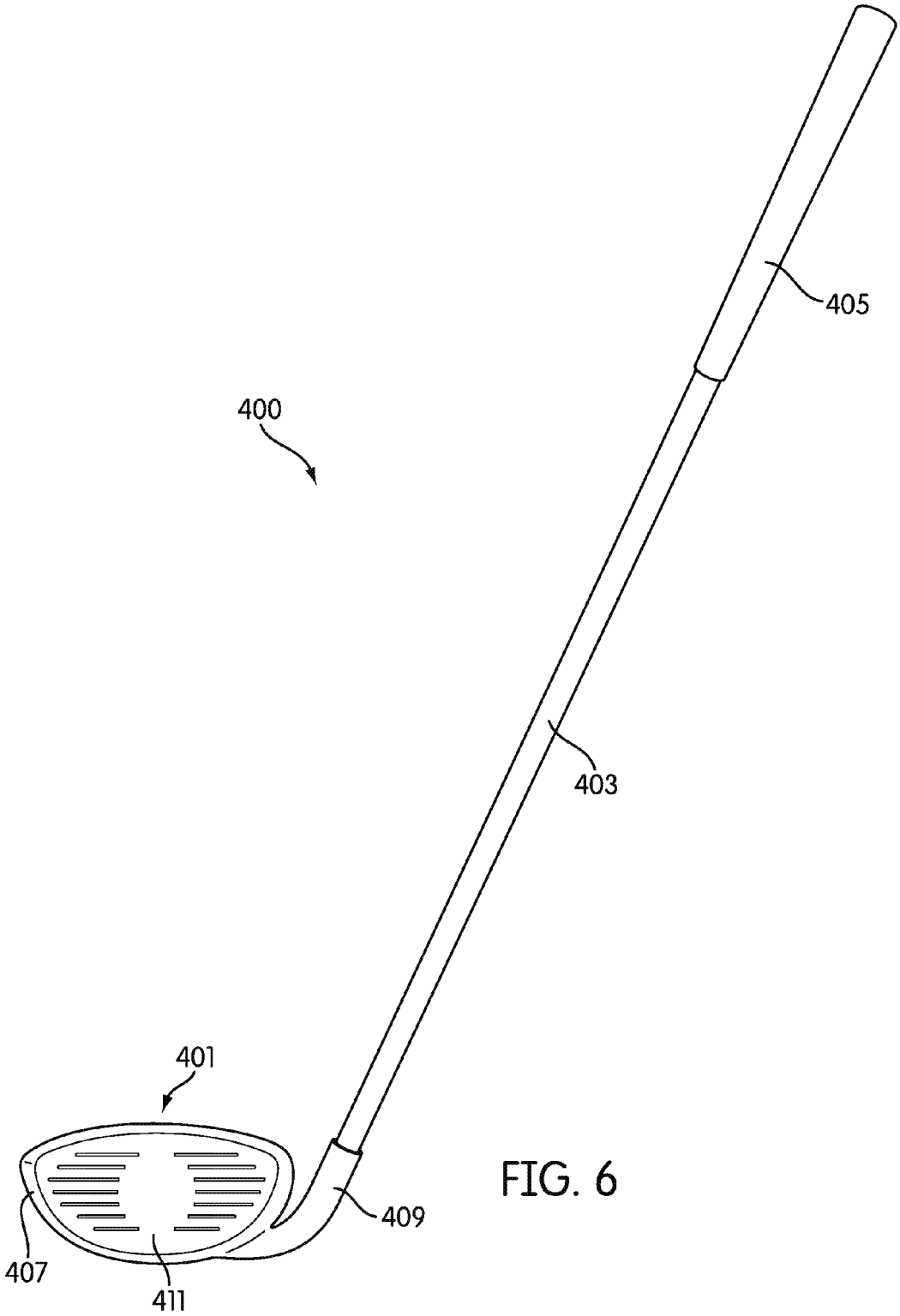
FIG. 6 is an illustrative embodiment of an wood-type golf club structure according to aspects of the disclosure.

While iron-type golf clubs and iron-type golf club heads have been described in detail above, other aspects of this disclosure relate to wood-type golf clubs and wood-type golf club heads. For example, FIG. 6 generally illustrates an example of a wood-type golf club 400 according to aspects of the disclosure. As seen in FIG. 6, the wood-type golf club may include an wood-type golf club head 401 in accordance with the present disclosure.

In addition to the golf club head 401, the overall golf club structure 400 may include a shaft 403 and a grip or handle 405 attached to the shaft 403. The shaft 103 may be received in, engaged with, and/or attached to the golf club head 401, for example, through a shaft-receiving sleeve or element extending into the club head 401 (e.g., the shaft engaging member discussed below), via a hosel (e.g., a hosel included in the shaft engaging member discussed below), and/or directly to the club head structure 401, e.g., via adhesives, cements, welding, soldering, mechanical connectors (such as threads, retaining elements, or the like). If desired, the shaft 403 may be connected to the golf club head 401 and/or the shaft engaging member in a releasable manner using mechanical connectors to allow easy interchange of one shaft for another on the head.

The shaft 403 and handle 405 may have any of the features, materials, and/or characteristics of shaft 103 and handle 105 described above, including conventional features, materials, and/or characteristics as are known and used in the art.

According to aspects of the disclosure, the golf club head 401 may include a golf club head body 407 and a shaft engaging member 409. Further, according to aspects of the disclosure, the golf club head body 401 may also include a ball striking face 411. In some example structures, the ball striking face 411 may be integrally formed with at least some portion of the golf club head body 407 as a unitary, one-piece construction. According to other examples, the ball striking face 411 may include a separate element, such as a face plate, which is configured to be engaged with the golf club head body 407. For example, the golf club head body 407 may include a structure, such as a recess, notch, frame, or other configuration for receiving the face plate. According to aspects of the disclosure, the face plate may be engaged with the golf club head body 407 in a variety of ways. For example, the face plate may be engaged with the golf club head body 407 by press fitting; bonding with adhesives or cements; welding (e.g., laser welding), soldering, brazing, or other fusing techniques; mechanical connectors; etc.

According to aspects of the disclosure, the ball striking face 411 may be comprised of one or more materials. The material(s) of the ball striking face should be relatively durable to withstand the repeated impacts with the golf ball. According to aspects of the disclosure, the ball striking face 411 may comprise a high strength steel. Further, other materials, such as titanium or other metals or alloys may be used as well. Further, according to aspects of the disclosure, the ball striking face 411 may include one or more score lines or groove that extend generally horizontally across the ball striking face 411 (when the club head is oriented in a ball address position).

Figure 7:
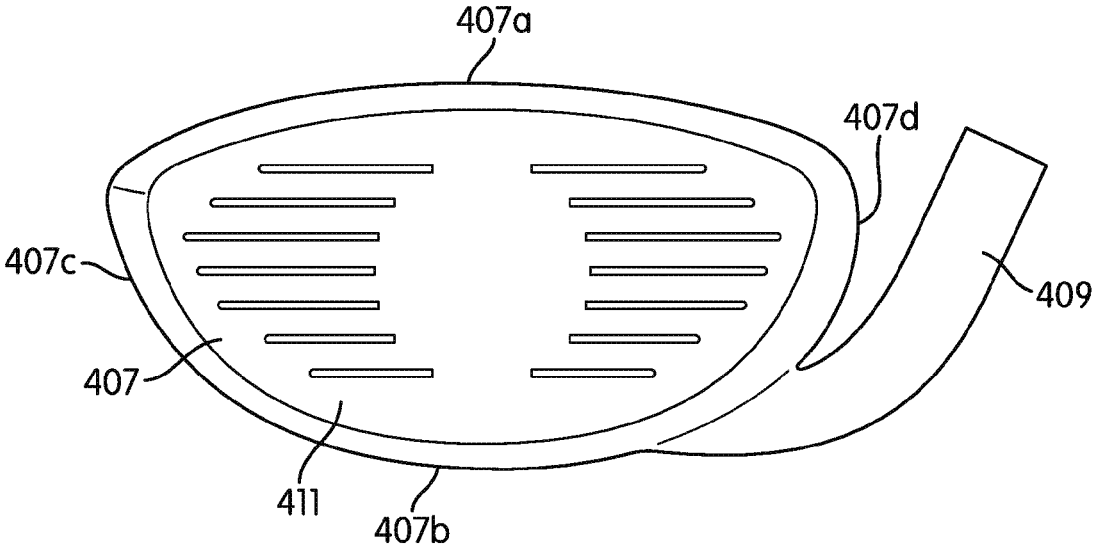
FIG. 7 is an enlarged view of the iron-type golf club head shown in FIG. 6.

As described above, the golf club head 401 may include the golf club head body 407 and the shaft engaging member 409. Aspects of the disclosure relate to particular structures of the golf club head body 407 and the shaft engaging member 409. According to aspects of the disclosure, the golf club head body 407 and the shaft engaging member 409 may be integral. FIG. 7 illustrates an enlarged view of the golf club head 401 wherein the golf club head body 407 and the shaft engaging member 409 are integrally formed as a unitary, one-piece construction.

According to aspects of the disclosure, the golf club head body 407 may be constructed in any suitable or desired manner and/or from any suitable or desired materials without departing from this disclosure, including from conventional materials and/or in conventional manners known and used in the art. In fact, it is noted that wide varieties of overall club head constructions are possible without departing from this disclosure. For example, if desired, some or all of the various individual parts of the club head body described above may be made from multiple pieces that are connected together (e.g., by adhesives or cements; by welding, soldering, brazing, or other fusing techniques; by mechanical connectors; etc.). The various parts (e.g., crown, sole, face, etc.) may be made from any desired materials and combinations of different materials, including materials that are conventionally known and used in the art, such as metal materials, including lightweight metal materials (e.g., titanium, titanium alloys, aluminum, aluminum alloys, magnesium, magnesium alloys, etc.), composite materials, polymer materials, etc. The club head 401 and/or its various parts may be made by forging, casting, molding, machining, stamping, and/or using other techniques and processes, including techniques and processes that are conventional and known in the art.

According to aspects of the disclosure, the golf club head body 407 may include a crown 407*a*, a sole 407*b*, a toe end 407*c*, and a heel end 407*d*. Further, according to aspects of the disclosure, the heel end 407*d* of the golf club head body 407 may be relatively curved. For example, the heel end 407*d* of the golf club head body 407 may formed as a relatively arcuate surface that extends from the sole 407*b* of the golf club head body 407 (e.g., the heel end 407*d* may extend substantially upward in an arcuate fashion when the golf club head 401 is at the ball address position).

As discussed above, the golf club head 401 may include a shaft engaging member 409. The shaft engaging member may 409 may be configured to receive the shaft 403. Further, according to aspects of the disclosure, the golf club head body 407 and the shaft engaging member 409 may be integral. For example, according to aspects of the disclosure, when the golf club head 401 is formed (e.g., through one of the above described methods) the golf club head body 407 and the shaft engaging member 409 are formed as part of golf club head 401 during the manufacturing process.

According to aspects of the disclosure, and as shown in FIG. 7, the golf club head 401 may be configured such that the shaft engaging member 409 extends from the sole 407*b* or the heel end 407*d* of the golf club head body 407. For example, the shaft engaging member 409 may extend from the sole 407*b* of the golf club head body 407 or a lower portion (e.g., a lower ½, ⅓, or ¼) of the heel end 407*d* of the golf club head body 407 or a lower portion (e.g., a lower ½, ⅓, or ¼) of the overall golf club head body 407. For example, the shaft engaging member 409 may be oriented so that at least a portion of the shaft engaging member 409 extends horizontally, or relatively horizontally, from the sole 407*b* of the golf club head body 407 or a lower portion (e.g., a lower ½, ⅓, or ¼) of the heel end 407*d* of the golf club head body 407 or a lower portion (e.g., a lower ½, ⅓, or ¼) of the overall golf club head body 407. Further, according to aspects of the disclosure, the shaft engaging member 409 may be curved, or bent, so that at least a portion of the shaft engaging member 409 extends relatively upward and away from the golf club head body 407 when the golf club 400 is at the ball address position.

Further, according to aspects of the disclosure, shaft engaging member 409 may include a hosel. According to aspects of the disclosure, the shaft 403 may be received in and/or inserted into and/or through the hosel. If desired, the shaft engaging member 409 may be configured such that the shaft 403 may be engaged with the shaft engaging member 409 in a releasable and/or adjustable manner using mechanical connectors to allow easy interchange of one shaft for another on the head and/or to allow adjustment of the orientation of the shaft 403 with respect to the golf club head 407. For example, threads, locking mechanisms, and the like may be incorporated into the shaft engaging member 409 and the end of the shaft 403 that is to be engaged with the shaft engaging member 409 may be configured with a corresponding configuration. Also, the shaft 403 may be secured to the shaft connecting member 409 via bonding with adhesives or cements, welding (e.g., laser welding), soldering, brazing, or other fusing techniques, etc.

Further, optionally, if desired, the hosel may be eliminated and the shaft 403 may be otherwise attached to the golf club head 401 through the shaft engaging member 409 of the golf club head 401. For example, the shaft 403 may be otherwise engaged with the shaft engaging member 409 by bonding with adhesives or cements; welding (e.g., laser welding), soldering, brazing, or other fusing techniques; etc.

According to aspects of the disclosure, the shaft engaging member 409 may be configured such that the bottom portion of the shaft engaging member 409 that extends from the golf club head body 407 in a generally horizontal manner does not engage with the crown of the golf club head body 407. For example, according to aspects of the disclosure, the bottom portion of shaft engaging member 409 that extends from the golf club head body 407 may be at a position that is less than ¾, ½, or ¼ of the overall height of the golf club head body 407 or is less than ¾, ½, or ¼ of the overall height of the heel end of the golf club head body 407.

Therefore, as seen in FIG. 7, in such a configuration, a space or gap may be provided between heel end 407*d* of the golf club head body 407 and the shaft engaging member 409. For example, according to aspects of the disclosure, the golf club head body 407 and the shaft engaging member 409 may be configured to provide a space or gap between the upper portion (e.g., the upper ¾, ½, ¼, etc.) of the heel of club head body 407*d* and the shaft engaging member 409. In this configuration, as seen in FIG. 7, an upper portion of the heel end 407*d* (e.g., the upper ¾, ½, ¼, etc.) is exposed and does not contact the shaft engaging member 409.

According to aspects of the disclosure, the shaft engaging member 409 may be configured such that the point where the shaft engaging member 409 extends from the golf club head body 407 (or the entire connection between the shaft engaging member 409 and the golf club head body 407) is below the center of gravity of the wood-type golf club head 401 and/or below the center of gravity of the wood-type golf club head body 407 and/or below the geometric center of the ball striking face of the wood-type golf club head. For example, according to aspects of the disclosure, the shaft engaging member 409 may be configured such that the entire portion of shaft engaging member 409 that is directly contacting the golf club head body 409 is below the center of gravity of the wood-type golf club head 401 and/or below the center of gravity of the wood-type golf club head body 407 and/or below the center of the ball striking face of the wood-type golf club head.

Figure 8:
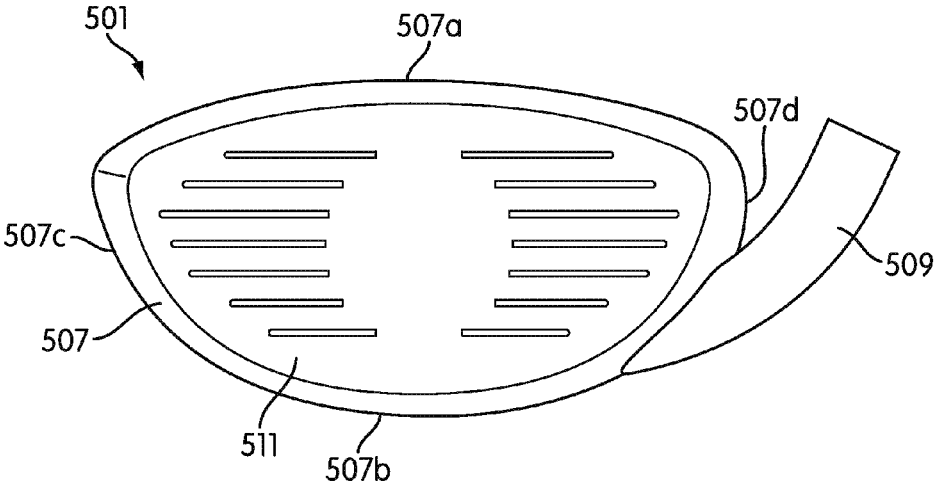
FIG. 8 is an illustrative embodiment of another wood-type golf club structure according to aspects of the disclosure.
Figure 9:
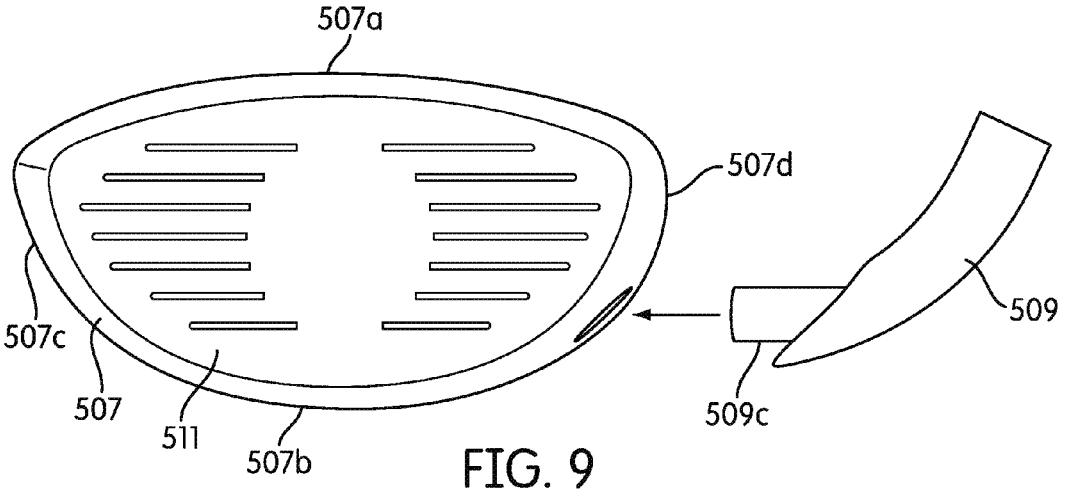
FIG. 9 is an exploded view of the wood-type golf club head shown in FIG. 8.

Additionally, it is noted that while the above described embodiments reference a golf club head wherein the golf club head body and the shaft engaging member are integral, according to other aspects of the disclosure, the golf club head body and the shaft engaging member may be separate pieces that are configured to be engaged with each other. FIGS. 8 and 9 illustrate various views of a golf club head 501 according to such an embodiment of this disclosure. Specifically, FIG. 8 is a front view of an illustrative embodiment of the golf club head 501 according to aspects of the disclosure and FIG. 9 is an exploded view of the embodiment of the golf club head 501 shown in FIG. 8.

As seen in FIGS. 8 and 9, the golf club head body 507 and the shaft engaging member 509 may be formed as separate pieces configured to be engaged with each other, such as in the manners described above. For example, the shaft engaging member 509 may include a protrusion 509*c* that is configured to engage with connecting structure (e.g., a hole) in the golf club head body 507. Further any other connection means and methods, such as the ones described above, may be employed here as well. In fact, it is noted that the features of the golf club head 501 are similar to the embodiments described above and, therefore, will not be again described in great detail here for the sake of brevity.

However, it is noted that in the embodiment depicted in FIGS. 8 and 9, similar to the embodiment of FIGS. 6 and 7, the entire connection between the golf club head body 507 and the shaft engaging member 509 may be located below the center of gravity of the wood-type golf club head 501 and/or below the center of gravity of the wood-type golf club head body 507 and/or below the geometric center of the ball striking face of the wood-type golf club head 501.

It is noted that the above described configurations of golf club head 401 may allow for the shaft engaging member 409 to be extend from the golf club head body 407 at a point that is below the center of gravity of the wood-type golf club head 401 and/or below the center of gravity of the wood-type golf club head body 407 and/or below the geometric center of the ball striking face of the wood-type golf club head 401. Further, according to aspects of the disclosure, the above described configurations of golf club head 401 may allow for the entire connection between the golf club head body 407 and the shaft engaging member 409 to be below the center of gravity of the wood-type golf club head 401 and/or below the center of gravity of the wood-type golf club head body 407 and/or below the geometric center of the ball striking face of the wood-type golf club head 401.

Figure 10A:
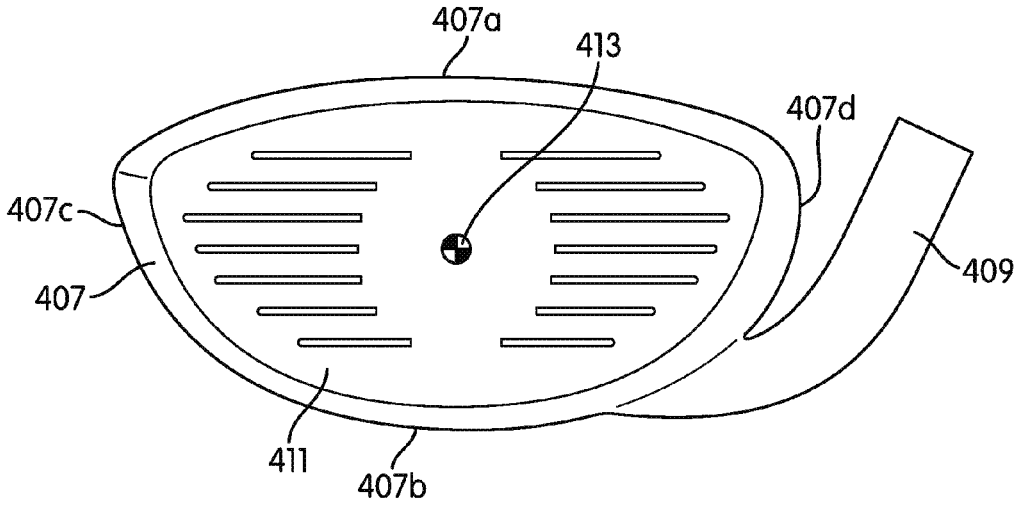
FIG. 10A is another view of the golf club head shown in FIG. 6 wherein the center of gravity of the golf club head is symbolically illustrated.

For example, FIG. 10A illustrates the golf club head 401 wherein the center of gravity of the golf club head 401 is shown symbolically at reference numeral 413. As seen in FIG. 10A, the entire connection between the golf club head body 407 and the shaft engaging member 409 is below the center of gravity 413 of the wood-type golf club head 401 and/or below the center of gravity of the wood-type golf club head body 407 and/or below the geometric center of the ball striking face of the wood-type golf club head 401.

Figure 10B:
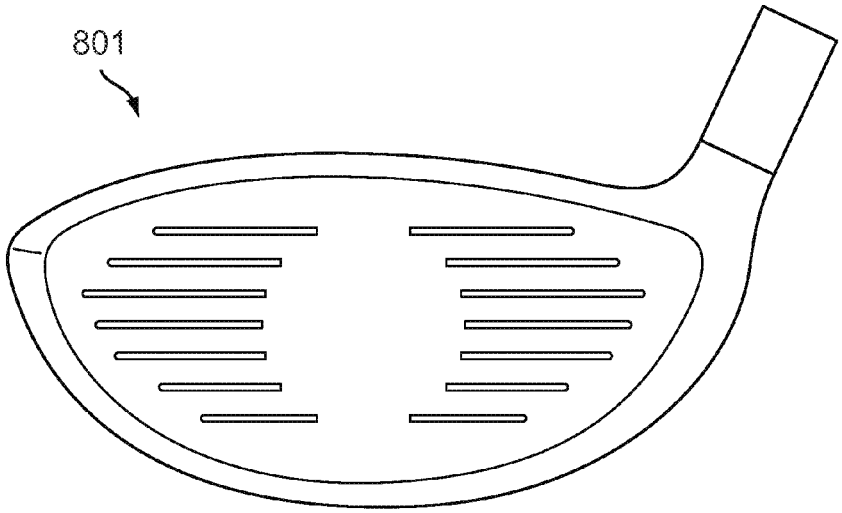
FIG. 10B PRIOR ART
FIG. 10B is a conventional wood-type golf club head.

In contrast, FIG. 10B illustrates a conventional golf club head 801. As seen in FIG. 10B, the golf club head is a single integral piece wherein the hosel portion of the golf club head 801 is integral with the remainder of the golf club head 801 and in the upper portion of the golf club head 801. Hence, in contrast to the golf club head 401 of the present disclosure, golf club head 801 does not have an entire connection between the golf club head body and the shaft engaging member below the center of gravity of the golf club head.

A wood-type golf club head configured according to aspects of the disclosure can be particularly advantageous. For example, as will be described in detail below, positioning the connection between the golf club head body and the shaft engaging member below the center of gravity of the golf club head and/or the center of gravity of the golf club head body and below the preferred impact position between the golf ball and the ball striking face, may act to provide increased energy transfer.

Further, positioning the connection between the golf club head body and the shaft engaging member below the center of gravity of the golf club head and/or the center of gravity of the golf club head body and below the preferred impact position between the golf ball and the ball striking face, may act to increase "feel" of the golf club, or provide better frequencies of feel to the golfer.

FIGS. 11-20 illustrate additional embodiments of iron-type golf club heads according to aspects of the present invention. The embodiments of golf club heads 601, 701 shown in FIGS. 11-20 and described below include many components that are similar to components referenced and described herein with respect to the iron-type golf club heads 101, 201 in FIGS. 1-5A. Such similar elements may not be described in detail again for purposes of brevity, and it is understood that any components described above may be incorporated into the embodiments of FIGS. 11-20.

Figures 11A, 11B:
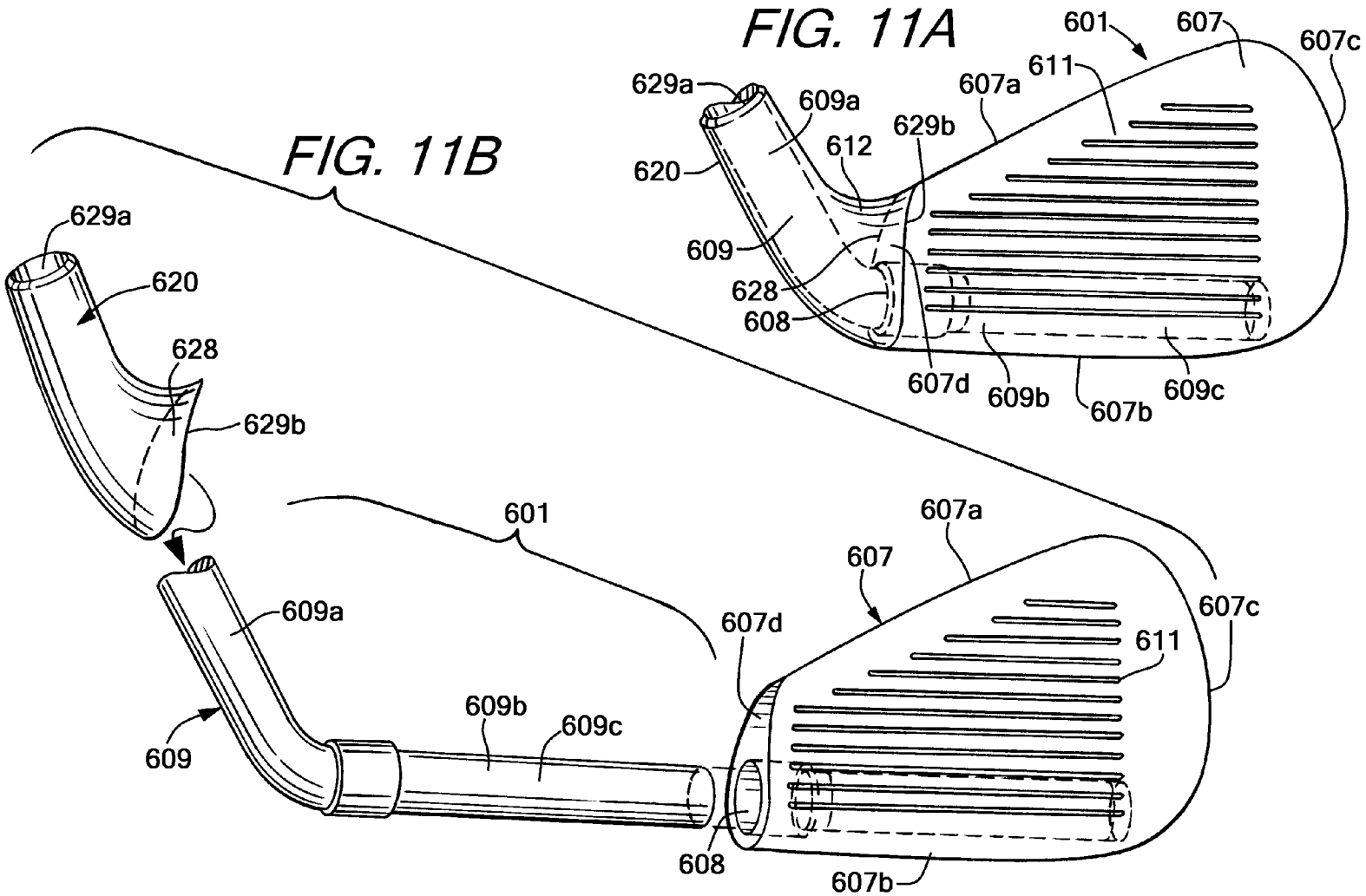
FIG. 11A is a front view of an illustrative embodiment of another iron-type golf club structure according to aspects of the disclosure.
FIG. 11B is a front exploded view of the club head of FIG. 11A.
Figures 12A, 12B:
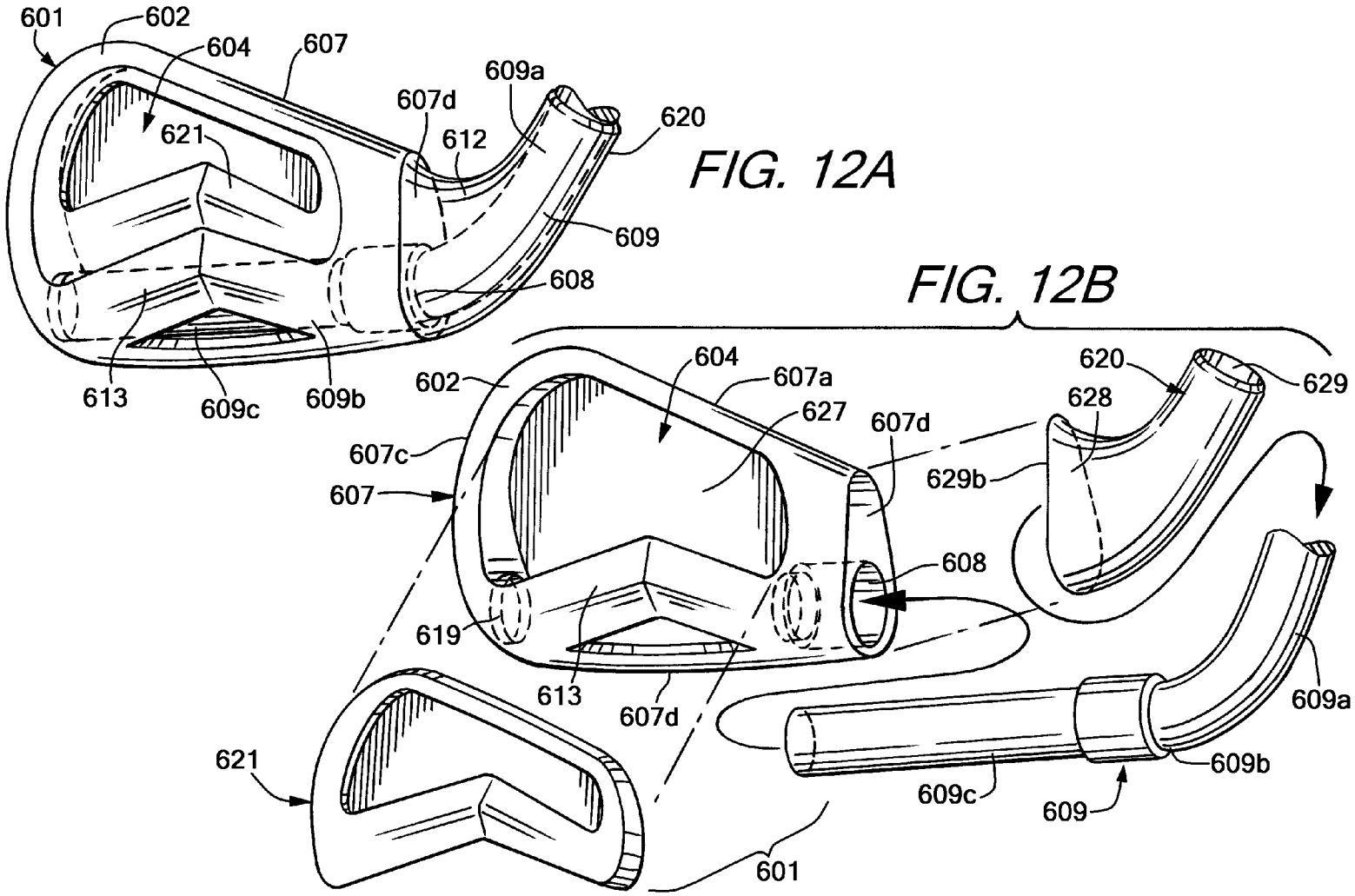
FIG. 12A is a rear view of the club head of FIG. 11A.
FIG. 12B is a rear exploded view of the club head of FIG. 11A

FIGS. 11-12 illustrate an embodiment of an iron-type golf club head 601 having an iron-type golf club head body 607 that has a striking face 611 at the front of the body 607, a top 607*a*, a sole 607*b*, a toe end 607*c*, and a heel end 607*d*. The body 607 in this embodiment also has a perimeter weighting member 602 extending rearward from the face 611 around at least a portion of the periphery of the face 611 (or the entire periphery as shown in FIGS. 12A-B), and a rear cavity 604 located behind the face 611 and defined at least partially by the perimeter weighting member 602. The rear cavity 604 may also be at least partially defined by a cavity wall 627, which may be a rear surface of the face 611 or another structure located at the front of the rear cavity 604. The body 607 also has connecting structure for engaging and/or connecting to a shaft engaging member 609, which in this embodiment includes a hole 608 on the heel end 607*d* of the body 607. The body 607 in FIGS. 11-12 has a flat or substantially flat surface on the heel end 607*d*, and the hole 608 is formed in the flat heel surface in this embodiment.

The golf club head body 607 may be made of a variety of materials, including materials described above, such as titanium, stainless steel, aluminum, and/or other metallic materials, as well as polymers (including fiber reinforced polymers) and other types of materials. The body 607 may be made of a single, integral piece, such as by casting, forging, molding, etc., or may be made of multiple pieces connected together using appropriate techniques. In one embodiment, at least part of the body 607 is formed of a nanocoated or other coated lightweight material, such as a high strength polymer (e.g., an injection molded plastic) that is coated with a thin layer of a metallic material. For example, in one embodiment, the body 607 may be partially or entirely formed of a high strength polymer such as polyether ether ketone (PEEK) or other high strength polymer, coated with aluminum or other metal. Such a formation can create a complex structure for the body 607 with sufficient strength for performance, while also providing a lightweight structure, which may have a lower weight and/or density than the shaft engaging member 609. In one embodiment, the entire body 607 may have a lower weight and/or density than the protrusion 609*c* alone, particularly so if the protrusion 609*c* is weighted as described herein. Additionally, by using a lightweight coated polymer structure, the head 601 can be manufactured so that a significant portion (even a majority) of the weight of the head can be provided by the shaft engaging member 609. Further, in embodiments where the second portion 609*b* of the shaft engaging member 609 is positioned below the center of gravity of the body 607, this configuration can create an overall lower center of gravity for the head 601. Such a lower center of gravity may be desirable for certain clubs and/or golfers, such as to provide a higher ball flight trajectory.

The shaft engaging member 609 in this embodiment includes a first portion 609*a* that is connected to a second portion 609*b* configured for engaging the connecting structure of the body 607. The first portion 609*a* may be or include an upwardly extending leg, and the first portion 609*a* in the embodiment of FIGS. 11-12 is angled with respect to the second portion 609*b* and extends upwardly and away from the second portion 609*b* and from the heel end 607*d* when the shaft engaging member 609 is connected to the body 607. A gap 612 is thereby formed and defined between the first portion 609*a* of the shaft engaging member 609 and the heel end 607*d* of the golf club head body 607. The second portion 609*b* in this embodiment includes a protrusion 609*c* that extends inwardly into the hole 608 in the golf club head body 607 in a heel-to-toe direction. It is understood that the first portion 609*a* may be configured with a hosel or other shaft connection structure (not shown) configured for connection of a shaft, as shown in FIG. 1 and described herein. In another embodiment, the first portion 609*a* may be integral with the shaft.

Figure 16:
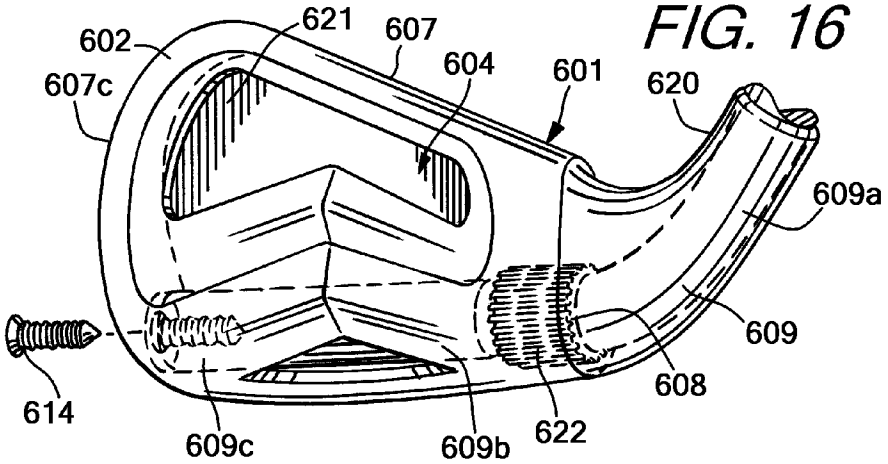
FIG. 16 is a rear view of one embodiment of a connecting structure adaptable for use with the club head of FIG. 13A.
Figure 17:
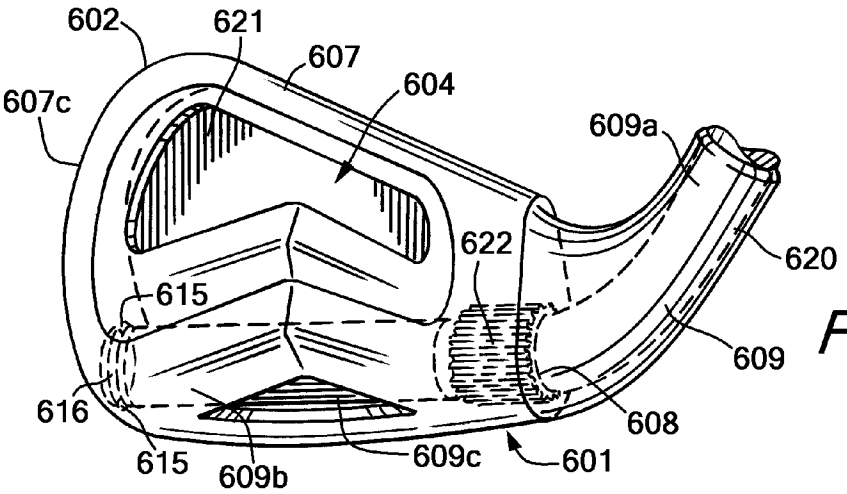
FIG. 17 is a rear view of another embodiment of a connecting structure adaptable for use with the club head of FIG. 13A.

In the embodiment of FIGS. 11-12, the hole 608 extends inwardly into the body 607 in a heel-to-toe direction, and forms a passage that is in communication with the rear cavity 604 of the body 607. A bridge 613 is formed by arms extending from the perimeter weighting member 602 and extending over at least a portion of the rear cavity 604, where at least a portion of the bridge 613 is spaced from both the top and bottom sides of the perimeter weighting member 602 and/or the top and bottom edges of the rear cavity 604. The second portion 609*b* of the shaft engaging member 609 may be connected and retained in connection with the body 607 in a variety of ways, including the techniques and structures described above with respect to the embodiments of FIGS. 1-5, such as through using a securing member. FIGS. 16-17 illustrate different example embodiments of securing members that may be used for connecting the shaft engaging member 609 with the body 607. In FIG. 16, a screw 614 or other fastener is engaged with the end of the protrusion 609*c*, and connects the protrusion 609*c* to the toe end 607*c* of the golf club head body 607. The screw 614 may be received through an aperture in the toe end 607*c* in this embodiment. In FIG. 17, a releasable snap connection structure is utilized, including spring loaded balls or other members 615 that are biased to engage a channel 616 in the end of the protrusion 609*c*. Other embodiments of connecting structures may be additionally or alternately used. The body 607 may further contain a receiver 619 (e.g., a hole or recess) near the toe end 607*c* that receives the distal end of the protrusion 609*c*.

The golf club head 601 of FIGS. 11-12 may also contain a shroud 620 that engages at least one of the body 607 and the shaft engaging member 609 and at least partially covers the shaft engaging member 609, the connecting structure of the body 607, and/or the gap 612 between the first portion 609*a* of the shaft engaging member 609 and the heel end 607*d* of the body 607. The shroud 609 may receive at least a portion of the first portion 609*a* (i.e. the leg) and/or the second portion 609*b* of the shaft engaging member 609 to accomplish this function. The shroud 620 may be purely cosmetic in one embodiment, and may be configured to create the appearance of an integral hosel such as in the prior art embodiment shown in FIG. 5B. In other embodiments, the shroud 620 may serve a structural or other functional purpose. In the embodiment of FIGS. 11-12, the shroud 620 receives and partially covers the first and second portions 609*a,b* of the shaft engaging member 609, and completely covers the heel end 607*d* and the hole 608 of the body 607. Additionally, the shroud 620 in this embodiment extends across the gap 612 to engage both the body 607 and the first portion 609*a* of the shaft engaging member 609, and at least partially covers the gap 612. The shroud 620 in this embodiment has two end openings 629*a* and 629*b*. The first opening 629*a* receives the first portion 609*a* of the shaft engaging member 609 therethrough, and the second opening 629*b* allows the second portion 609*b* of the shaft engaging member 609 to extend through to connect to the body 607. The second opening 629*b* also engages and surrounds the flat surface at the heel end 607*d* of the body 607 in this embodiment. The shroud 620 as shown in FIGS. 11-12 has a flared end portion 628 around the second opening 629*b*, such that the second opening 629*b* is also flared. Further, the shroud 620 (or the flared end portion 628 thereof) may have surfaces that are substantially flush and/or contiguous with one or more surfaces of the golf club head body 607 around the heel end 607*d*, such as the top 607*a*, the sole 607*b*, the face 611, and/or the rear of the perimeter weighting member 602. The shroud 620 may be a shell made from plastic or other polymer material (including fiber reinforced polymers or other composites) in one embodiment, however it is understood that other materials may be used in other embodiments. It is further understood that the shroud 620 may have a different configuration in another embodiment.

The golf club head 601 in FIGS. 11-12 further includes a badge 621 that is at least partially received in the rear cavity 604 to fill and/or cover at least a portion of the rear cavity 604. In the embodiment illustrated in FIGS. 12A-B, the badge 621 fills and/or covers the opening of the rear cavity between the bridge 613 and the upper end of the rear cavity 604, and also extends across the rear cavity 604 in a heel-to-toe direction. The badge 621 in this embodiment is a thin plastic plate that may have identifying and/or cosmetic indicia thereon, and the badge 621 can serve various functions, including cosmetic functions and/or keeping dirt or debris out of the rear cavity 604. The badge 621 may include different components or structure in other embodiments, and may also perform additional functions. In a further embodiment, the golf club head 601 may not have any badge 621 or may have multiple badges 621.

FIGS. 13-14 illustrate an embodiment of an iron-type golf club head 601 having a structure similar to the embodiment of FIGS. 11-12. The embodiment of FIGS. 13-14 includes an iron-type golf club head body 607 that has a striking face 611 at the front of the body 607, a top 607*a*, a sole 607*b*, a toe end 607*c*, and a heel end 607*d*. The body 607 in this embodiment also has a perimeter weighting member 602 extending rearward from the face 611 around at least a portion of the periphery of the face 611 (or the entire periphery as shown in FIGS.

12A-B), and a rear cavity 604 located behind the face 611 and defined at least partially by the perimeter weighting member 602. The body 607 also has connecting structure for engaging and/or connecting to a shaft engaging member 609, which in this embodiment includes a hole 608 on the heel end 607*d* of the body 607. The body 607 in FIGS. 13-14 has a flat or substantially flat surface on the heel end 607*d*, and the hole 608 is formed in the flat heel surface in this embodiment. The head 601 also includes a badge 621 as described herein with respect to FIGS. 11-12.

Figures 13A, 13B:
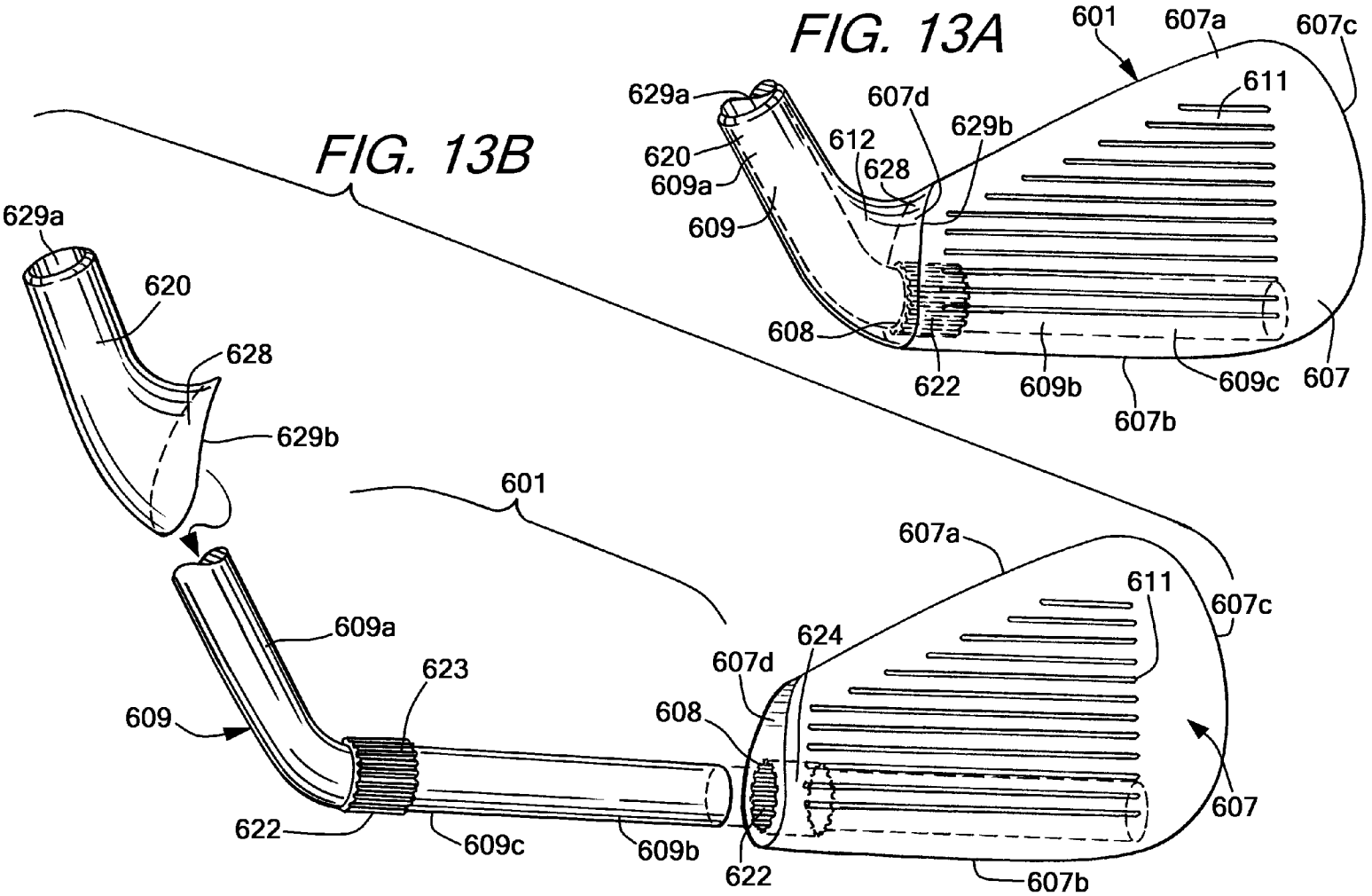
FIG. 13A is a front view of an illustrative embodiment of another iron-type golf club structure according to aspects of the disclosure.
FIG. 13B is a front exploded view of the club head of FIG. 13A.
Figures 14A, 14B:
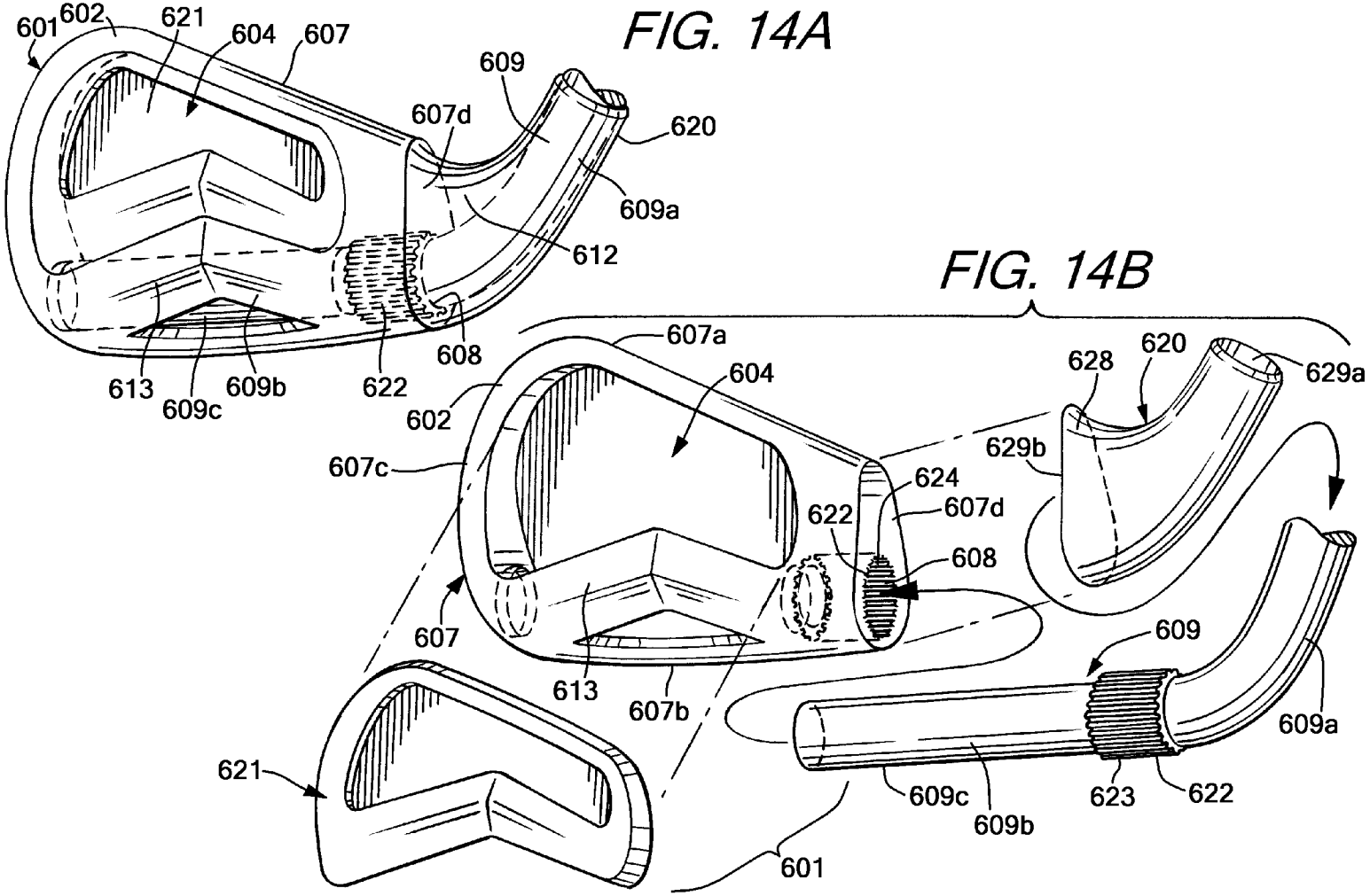
FIG. 14A is a rear view of the club head of FIG. 13A.
FIG. 14B is a rear exploded view of the club head of FIG. 13A.
Figure 15:
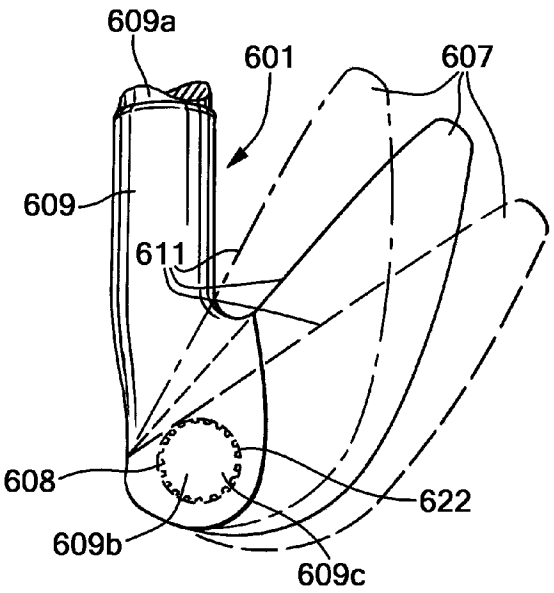
FIG. 15 is a side schematic view of the club head of FIG. 13A, shown in a plurality of different rotational positions.

In the embodiment of FIGS. 13-14, the connecting structure of the body 607 and the shaft engaging member 609 include complementary rotational locking structure that rotationally locks the body 607 and the shaft engaging member 609 together in a plurality of different positions, which can be used to change the loft angle of the club head 601, as described above. FIG. 15 illustrates the body 607 being locked in multiple different positions with respect to the shaft engaging member 609, and the different loft angles that may thereby be achieved. As shown in FIGS. 13-14, the rotational locking structure in this embodiment includes a plurality of complementary teeth 622 that engage each other to achieve rotational locking. As shown in FIG. 13B, the second portion 609*b* of the shaft engaging member 609 has an enlarged portion 623 that extends a portion of the length of the protrusion 609*c*, with the teeth 622 being positioned around the entire periphery of the enlarged portion 623. The enlarged portion 623 in this embodiment may therefore be considered a gear portion. Similarly, the hole 608 includes an enlarged opening portion 624 that extends over a portion of the length of the hole 608, with the teeth 622 being positioned around the entire periphery of the enlarged opening portion 624. In other embodiments, the teeth 622 may be positioned along at least a portion of or the entire length of the protrusion 609*c* and/or the hole 608. For example, the protrusion 609*c* may engage the cavity wall 627 and/or the bridge 613, which may have teeth 622 thereon as well. Additionally, in other embodiments, the teeth 622 may be positioned around at least a portion of or the entire periphery of the protrusion 609*c* and/or the hole 608. In a further embodiment, the rotational locking structure may not be complementary, and either the body 607 or the shaft engaging member 609 may include a rotational locking structure that can lock the head in different rotational positions with respect to the shaft engaging member 609, and thereby lock the head in different loft angles, as described herein.

The teeth 622 may be arranged and configured so that advancing the rotation of the shaft engaging member 609 relative to the body 607 changes the loft angle of the club head by a set amount, such as 1° in one embodiment. The embodiment shown in FIGS. 13-14 permits multiple different club heads with different loft angles to be manufactured using the same body member 607 and/or shaft engaging member 609. This can simplify manufacturing by reducing the number of different parts required to produce a full set of club heads, and can thereby reduce costs and increase efficiency. It is understood that different shrouds 620 may be utilized for heads 601 that may include the same body 607 and shaft engaging member 609, in order to maintain flush and contiguous surfaces between the shroud 620 and the body 607 when different loft angles are used. In a further embodiment, the rotational locking structure in FIGS. 13-14 may be configured to be releasable, reconnectable, and/or adjustable, in order to allow the rotational orientations of the body 607 and the shaft engaging member 609 and/or the loft angle of the club head 601 to be adjusted after manufacturing.

A releasable and reconnectable retaining structure may be utilized to retain the body 607 in connection with the shaft engaging member 609 in one of the multiple rotational positions. For example, the securing members shown in FIGS. 16-17 and described above may be releasable and reconnectable, and these or other structures may be used for this purpose in various embodiments. The head 601 as depicted in FIGS. 13-14 is otherwise structurally similar to the head of FIGS. 11-12, and the head 601 in FIGS. 13-14 may have any of the features or components described above with respect to FIGS. 11-12, as well as any variations or alternate embodiments as described above.

Figures 18A, 18B:
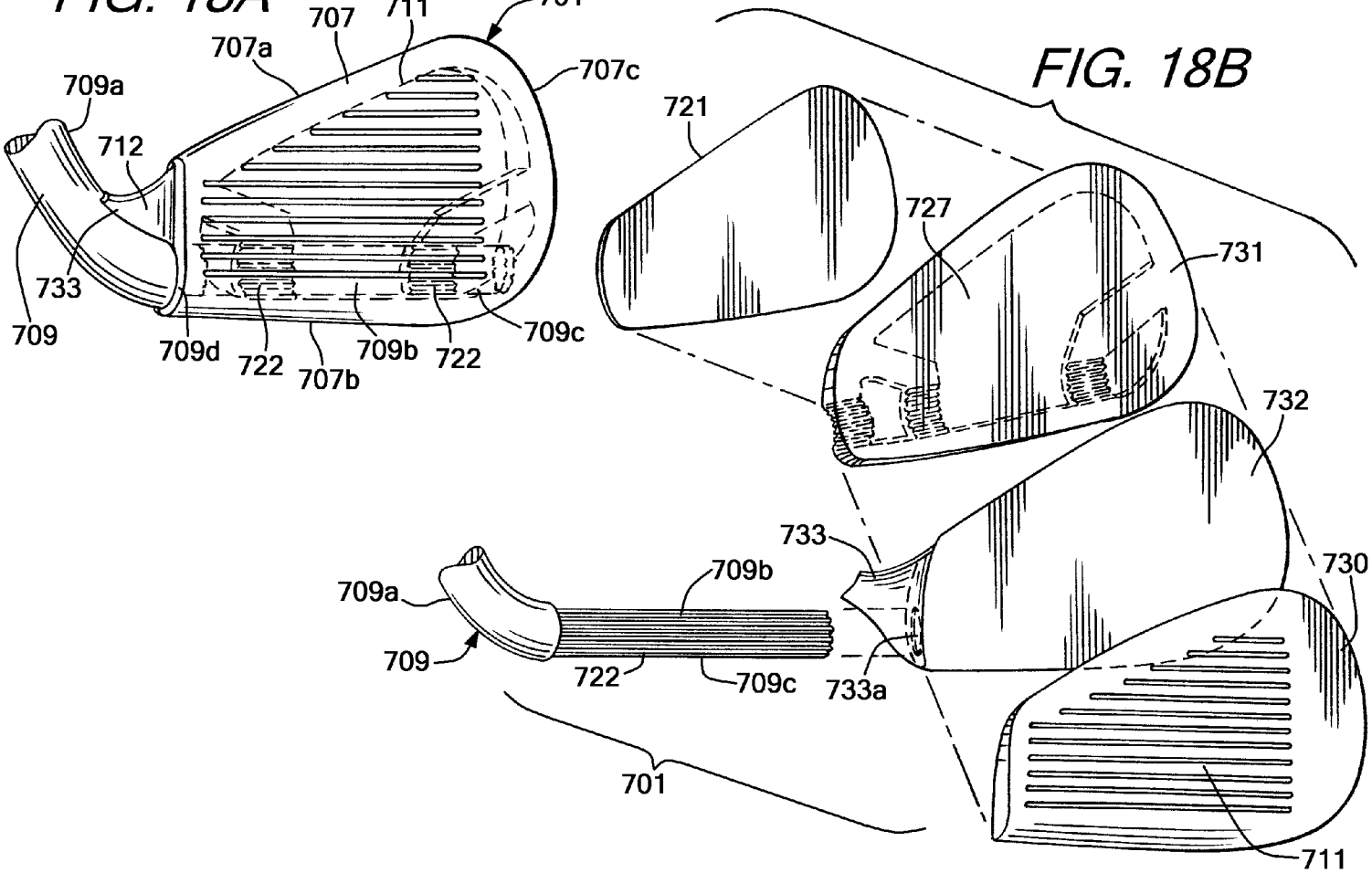
FIG. 18A is a front view of an illustrative embodiment of another iron-type golf club structure according to aspects of the disclosure.
FIG. 18B is a front exploded view of the club head of FIG. 18A.
Figures 19A, 19B:
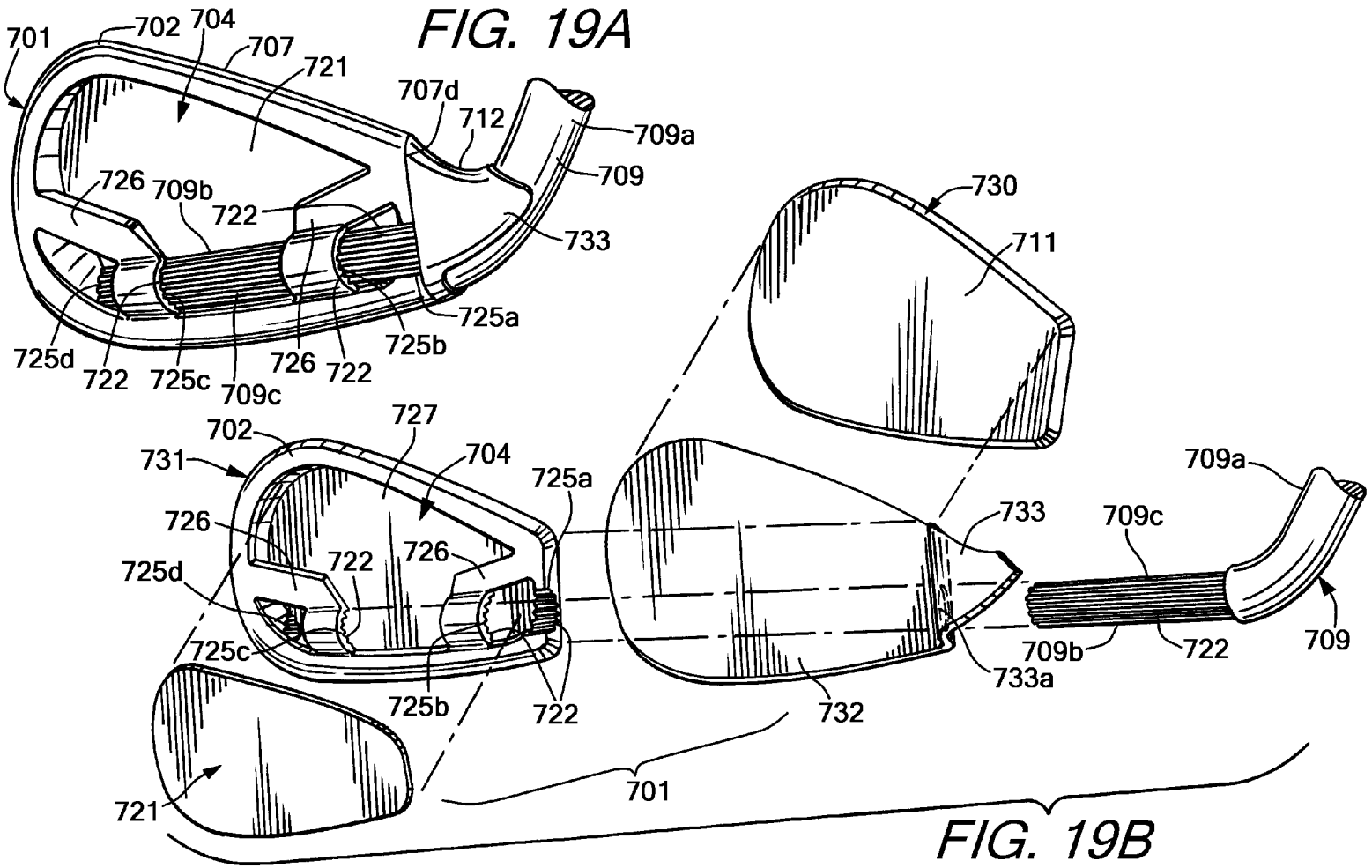
FIG. 19A is a rear view of the club head of FIG. 18A.
FIG. 19B is a rear exploded view of the club head of FIG. 18A.

FIGS. 18-19 illustrate an embodiment of an iron-type golf club head 701 that includes an iron-type golf club head body 707 that has a striking face 711 at the front of the body 707, a top 707*a*, a sole 707*b*, a toe end 707*c*, and a heel end 707*d*. The body 707 in this embodiment also has a perimeter weighting member 702 extending rearward from the face 711 around at least a portion of the periphery of the face 711 (or the entire periphery as shown in FIGS. 19A-B), and a rear cavity 704 located behind the face 711 and defined at least partially by the perimeter weighting member 702. The body 707 also has connecting structure for engaging and/or connecting to a shaft engaging member 709, which is described in greater detail below. The body 707 in FIGS. 18-19 also has a flat or substantially flat surface on the heel end 707*d* in this embodiment. The head 701 as depicted in FIGS. 18-19 may have some components and structural features in common with the heads 601 of FIGS. 11-14 described above, and such common components and structural features may be referred to using similar reference numbers (in the 7xx format) It is understood that the head 701 in FIGS. 18-19 may have any of the structural features described above with respect to FIGS. 11-14, as well as any variations or alternate embodiments as described above.

The shaft engaging member 709 in this embodiment includes a first portion 709*a* that is connected to a second portion 709*b* configured for engaging the connecting structure of the body 707, as similarly described above. The first portion 709*a* may be or include an upwardly extending leg, and the first portion 709*a* in the embodiment of FIGS. 18-19 is angled with respect to the second portion 709*b* and extends upwardly and away from the second portion 709*b* and from the heel end 707*d* when the shaft engaging member 709 is connected to the body 707. A gap 712 is thereby formed and defined between the first portion 709*a* of the shaft engaging member 709 and the heel end 707*d* of the golf club head body 707. The second portion 709*b* in this embodiment includes a protrusion 709*c* that extends inwardly into the golf club head body 707 in a heel-to-toe direction. In this embodiment, the protrusion 709*c* has gear teeth 722 that extend around the entire or substantially the entire periphery of the protrusion 709*c*, similarly to the embodiment of FIGS. 13-14. Additionally, the teeth 722 of this embodiment extend the entire or substantially the entire length of the protrusion 709*c*, in contrast to the teeth 622 shown in FIGS. 13-14, which extend only a portion of the length. The teeth 722 are configured to engage with the connecting structure of the body 707 to form a rotational locking structure, as described above and described further in greater detail below.

The body 707 in the embodiment of FIGS. 18-19 is formed of multiple pieces, including at least a front piece 730 forming the striking face 711 and a back piece 731 connected to the front piece 730 and forming the rear of the club head body 707. In the embodiment of FIGS. 18-19, the front and back pieces 730, 731 are each formed as a single, integral piece, however in other embodiments, the front piece 730 and/or the back piece 731 may be formed of multiple pieces connected together. Additionally, in the embodiment of FIGS. 18-19, front piece 730 forms the entire face 711, and the back piece 731 forms the entire perimeter weighting member 702, as well as the cavity wall 727 and the arms 726, and completely defines the rear cavity 704. The front and back pieces 730, 731 may be formed of any of the materials described herein. In one embodiment, the front and back pieces 730, 731 may be formed of the same material, and in another embodiment, the front and back pieces 730, 731 may be formed of different materials. For example, one of the front and back pieces 730, 731 may be formed of a material that is heavier than the other, in order to modify the weighting of the club head, e.g., shifting the CG of the head 701 forward or backward and/or changing the MOI of the head 701.

Figures 20A, 20B:
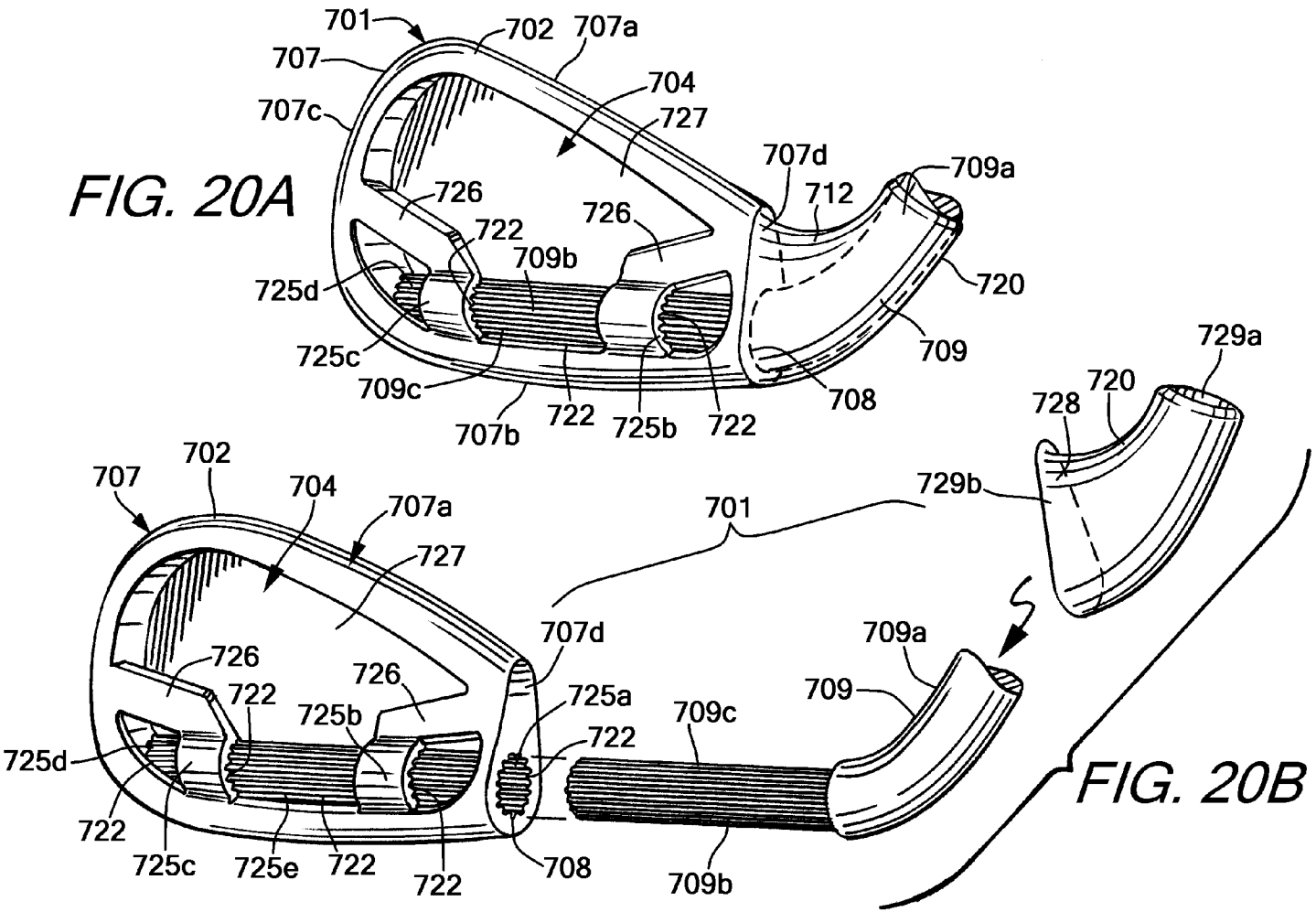
FIG. 20A is a rear view of an illustrative embodiment of another iron-type golf club structure according to aspects of the disclosure.
FIG. 20B is a rear exploded view of the club head of FIG. 20A.

The body 707 in the embodiment of FIGS. 18-19 also includes a polymer member 732 positioned between the front and back pieces 730, 731. In this configuration, the rear surface of the face 711 and the front surface of the cavity wall 727 confront each other, and the polymer member 732 is positioned between these surfaces and engages both surfaces. In another embodiment, the head 707 may not contain the polymer member 732, and the rear surface of the face 711 and the front surface of the cavity wall 727 may directly engage each other. The polymer member 732 may be formed of a material selected to provide specific properties to the head 701. As one example, the polymer member 732 may be made of an elastomeric material or similar resilient material in one embodiment, such as any of a variety of natural or synthetic rubbers (including silicone), in order to provide cushioning, sound dissipation, vibrational damping, etc. The polymer member 732 may further include an extension 733 that extends from the heel end 707*d* of the body 707 to form a shroud that at least partially covers the shaft engaging member 709 and/or the gap 712 between the heel end 707*d* and the first portion 709*a* of the shaft engaging member 709. In the embodiment of FIGS. 18-19, the extension 733 jogs rearwardly outside the periphery of the front and back pieces 730, 731, extends completely across the gap 712, and engages the first portion 709*a* of the shaft engaging member 709. The extension 733 may also include a hole 733*a* configured to allow passage of the protrusion 709*c* therethrough It is understood that the extension 733 may have a different configuration in other embodiments, and may wrap around a portion of the shaft engaging member 709 in one embodiment. The shroud formed by the extension 733 may have any properties or configurations of the shroud 620 as described above. In another embodiment, the polymer member 732 may not have an extension, and the head 701 may include a separate shroud (e.g., as shown in FIGS. 20A-B) or no shroud.

The front piece 730, back piece 731, and the polymer member 732 (if present) may be connected together in a variety of manners. For example, the polymer member 732 may be connected to the front and back pieces 730, 731 by an adhesive or other bonding material. As another example, screws or other fasteners may be used to connect the front piece 730, back piece 731, and the polymer member 732 (if present). As a further example, the polymer member 732 may have holes or cutouts that permit the front and back pieces 730, 731 to be directly connected together through the polymer member 732, such as by welding. The front and back pieces 730, 731 may be directly connected in this manner in an embodiment where the polymer member 732 is absent. Other connecting configurations are contemplated, including any configurations known in the art. It is understood that the front piece 730 may be considered to be "connected" to the back piece 731 even if there is no direct engagement or connection between the two pieces, such as if the polymer member 732 completely separates the front piece 730 from the back piece 731.

The body 707 has connecting structure for engaging the second portion 709*b* of the shaft engaging member 709, which includes multiple engagement surfaces 725*a-d* configured to engage the protrusion 709*c* from the front and back sides. As shown in FIGS. 18-19, a first engagement surface 725*a* is defined in the perimeter weighting member 702 at the heel 707*d* of the body 707, which engages the protrusion 709*c* from the front. The first engagement surface 725*a* is in the form of a recess or notch in the embodiment shown in FIGS. 18-19. One or more additional engagement surfaces, such as second and third engagement surfaces 725*b,c*, are defined on one or more arms 726 that extend across at least a portion of the rear cavity 704, which engage the protrusion 709*c* from the back. As shown in FIGS. 18-19, the body 707 has two arms 726 that extend across the lower heel and lower toe sides of the rear cavity 704. The arms 726 are connected at both ends to the perimeter weighting member 702 and form bridge members that are spaced from the perimeter weighting member 702 on both sides across the spans thereof. In another embodiment, the arms 726 may not be spaced from the perimeter weighting member 702 on one or both sides. Each arm 726 has a curved portion 728 defining a curved engagement surface 725 in this embodiment. A fourth engagement surface 725*d* may be positioned at the toe side of the rear cavity 704, within an inward facing surface of the perimeter weighting member 702, engaging the protrusion 709*c* at its distal end. The fourth engagement surface 725*d* may be configured as a cavity receiving the end of the protrusion 709*c* therein, but may be configured as a hole passing completely through the perimeter weighting member 702 in another embodiment. In this configuration, the passage that the protrusion 709*c* extends through is part of, or in communication with, the rear cavity 704. In an alternate embodiment, the body 707 may include a hole in the heel end 707*d* as part of the connecting structure. FIGS. 20A-B, described below, illustrate a hole 708 in an integral, single-piece body structure. In a further embodiment, the back piece 731 of the body 707 in FIGS. 18-19 may have a hole located at the heel end 707*d*.

In the embodiment of FIGS. 18-19, the connecting structure of the body 707 and the shaft engaging member 709 include complementary rotational locking structure that rotationally locks the body 707 and the shaft engaging member 709 together in a plurality of different positions, which can be used to change the loft angle of the club head 701, as described above. As shown in FIGS. 18-19, the rotational locking structure in this embodiment includes a plurality of complementary teeth 722 that engage each other to achieve rotational locking. As shown in FIG. 19B and described above, the second portion 709*b* of the shaft engaging member 709 has teeth 722 that extend the entire length of the protrusion 709*c*, with the teeth 722 being positioned around the entire periphery of the protrusion 709*c*. Similarly, the engagement surfaces 725 of the body 707 include teeth 722 positioned across the each entire surface. In other embodiments, the teeth 722 may be positioned along one or more portions of the length of the protrusion 709*c*, such as only at the locations of engagement with the engagement surfaces 725. Additionally, in other embodiments, the body 707 may have teeth 722 positioned along the entire length of the protrusion 709*c*, such as by having an engagement surface with teeth 722 positioned on the cavity wall 727. In a further embodiment, the teeth 622 may be positioned around at least a portion of or the entire periphery of the protrusion 709*c* and/or only on portions of the engagement surfaces 725. The teeth 722 may be arranged and configured so that advancing the rotation of the shaft engaging member 709 relative to the body 707 changes the loft angle of the club head by a set amount, as described above. It is understood that the extension 733 may be flexible in order to accommodate changes in loft angle due to different rotational locking positions. In a further embodiment, the rotational locking structure in FIGS. 18-19 may be configured to be releasable, reconnectable, and/or adjustable in order to allow the rotational orientations of the body 707 and the shaft engaging member 709 and/or the loft angle of the club head 701 to be adjusted after manufacturing.

A releasable and reconnectable retaining structure may be utilized to retain the body 707 in connection with the shaft engaging member 709 in one of the multiple rotational positions. For example, the securing members shown in FIGS. 16-17 and described above may be releasable and reconnectable, and these or other structures may be used for this purpose in various embodiments.

In the embodiment of FIGS. 18-19, all of the connecting structure and the rotational locking structure of the body 707, including the arms 726, the engagement surfaces 725, and the teeth 722, are located on the back piece 731 of the body 707. However, in other embodiments, one or more of such components may be located on the front piece 730 or elsewhere on the body 707, including on additional pieces (if present). In a further embodiment, such as where the body 707 is a single, integral piece, the connecting structure and/or the rotational locking structure may all be located on the single, integral piece, or may be formed at least in part by specially dedicated pieces connected to the integral body 707 (e.g., separate arms 726 welded to the body 707).

In further embodiments, other types of connecting structure and/or rotational locking structure may additionally or alternately be contained within the body 707. For example, in one embodiment, the cavity wall 727 may include connecting structure and/or rotational locking structure, such as in the embodiment of FIG. 20, as described in greater detail below. As another example, the body 707 may include additional braces, blocks, or other fixed structures configured to engage the protrusion 709*c*, in one embodiment. Further configurations are contemplated.

The golf club head 701 in FIGS. 18-19 further includes a badge 721 that is at least partially received in the rear cavity 704 to fill and/or cover at least a portion of the rear cavity 704. In the embodiment illustrated in FIGS. 19A-B, the badge 721 is positioned against the cavity wall 727 and covers some or all of the cavity wall 727. The badge 721 in this embodiment is a thin plastic plate that may have identifying and/or cosmetic indicia thereon, and the badge 721 can serve various functions as described above with respect to FIGS. 11-12. The badge 721 may include different components or structure in other embodiments, and may also perform additional functions. In a further embodiment, the golf club head 701 may not have any badge 721 or may have multiple badges 721.

FIGS. 20A-B illustrate an embodiment of an iron-type golf club head 701 having a structure similar to the embodiment of FIGS. 18-19. The embodiment of FIGS. 20A-B includes an iron-type golf club head body 707 that has a striking face 711 at the front of the body 707, a top 707*a*, a sole 707*b*, a toe end 707*c*, and a heel end 707*d*. The body 707 in this embodiment also has a perimeter weighting member 702 extending rearward from the face 711 around at least a portion of the periphery of the face 711 (or the entire periphery as shown in FIG. 20B), and a rear cavity 704 located behind the face 711 and defined at least partially by the perimeter weighting member 702. The body 707 in FIGS. 20A-B is formed of a single, integral piece, and does not include front and back pieces as in the embodiment of FIGS. 18-19. It is understood that structures such as the arms 726 may be separately connected to the integral body 707. The body 707 also has connecting structure for engaging and/or connecting to a shaft engaging member 709, which in this embodiment includes a hole 708 on the heel end 707*d* of the body 707. The body 707 in FIGS. 20A-B has a flat or substantially flat surface on the heel end 707*d*, and the hole 708 is formed in the flat heel surface in this embodiment. The hole 708 extends inwardly to a passage that receives the protrusion 709*c*, which is in communication with the rear cavity 704. The inner surface of the hole 708 forms an engagement surface 725*a* engaging around the entire periphery of the protrusion 709*c*, in addition to engagement surfaces 725*b-d* on the arms 726 and at the toe end of the rear cavity 704 as described with respect to FIGS. 18-19. The cavity wall 727 also has an engagement surface 725*e* in this embodiment, engaging the protrusion 709*c* from the front. The body 707 also has rotational locking structure including teeth 722 on all of the engagement surfaces 725 of the head 707, including around the inside of the hole 708 as described with respect to FIGS. 13-14, as well as on the arms 726 and at the end of the cavity 704 as described above with respect to FIGS. 18-19. Additional teeth 722 are included on the engagement surface 725*e* on the cavity wall 727. The rotational locking structure of the head 707 of FIGS. 20A-B can function in any manner described herein with respect to other embodiments. The head 701 as depicted in FIGS. 20A-B is otherwise structurally similar to the head of FIGS. 18-19, and the head 701 in FIGS. 20A-B may have any of the features or components described above with respect to FIGS. 18-19, as well as any variations or alternate embodiments as described above. As one example, the head 701 in FIGS. 20A-B is not illustrated as including a badge 721 as shown in FIGS. 18-19, but such a badge 721 may be included in other embodiments.

It is understood that any embodiments shown and described herein may incorporate one or more features shown and/or described herein with respect to any other embodiment. For example, the embodiments of FIGS. 11-20 may include any features shown and/or described herein with respect to FIGS. 1-10, and vice versa. As another example, any of the wood-type golf club heads described herein may include features shown and/or described with respect to iron-type golf club heads, and vice versa.

A wide variety of overall club head constructions are possible without departing from this disclosure. For example, it is noted that the dimensions and/or other characteristics of the golf club heads according to examples of this disclosure may vary significantly without departing from the disclosure. For example, the above described features and configurations may be incorporated into any wood-type club heads including, for example: wood-type hybrid clubs, fairway woods, drivers, etc.

III. Conclusion

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 10 may be used individually and/or in any combination or sub-combination without departing from this disclosure.

What is claimed is:

1. A golf club head comprising: a golf club head body having a striking face configured for striking a ball, the golf club head body having a connecting structure; a shaft engaging member engaged with the connecting structure of the golf club head body, wherein the shaft engaging member is configured to be engaged with a golf club shaft to connect the shaft to the golf club head body, the shaft engaging member comprising a first portion and a second portion that are angled with respect to each other, wherein the first portion extends upward and away from the golf club head body and the second portion is received in the connecting structure and extends into the golf club head body in a heel-to-toe direction, and wherein a gap is defined between the first portion and a heel of the golf club head body; and a shroud engaged with at least one of the golf club head body and the shaft engaging member and extending between the golf club head body and the shaft engaging member to at least partially cover the gap and the connecting structure, wherein the shroud receives at least a portion of the first portion of the shaft engaging member therein, wherein the connecting structure and the shaft engaging member have complementary rotational locking structures to rotationally lock the shaft engaging member with the connecting structure, and wherein the rotational locking structure is adjustable, such that the shaft engaging member is configured to be engaged with the connecting structure in at least a first rotational position and a second rotational position with respect to the golf club head body, wherein a loft angle of the golf club head in the first position is different from the loft angle of the golf club head in the second position.

2. The golf club head of claim 1, wherein the connecting structure comprises a hole in the golf club head body and wherein the shaft engaging member comprises a protrusion that is received in the hole and extends into the golf club head body in a heel-to-toe direction, wherein the rotational locking structures comprise a plurality of complementary teeth on the protrusion and the hole that engage each other to rotationally lock the shaft engaging member with the connecting structure.

3. The golf club head of claim 2, wherein the protrusion is positioned completely below the center of gravity of the golf club head body and completely below a geometric center of the striking face.

4. The golf club head of claim 2, wherein the protrusion has a gear portion occupying a portion of a length of the protrusion proximate a heel edge of the golf club head body, wherein the teeth on the protrusion are located on the gear portion.

5. The golf club head of claim 2, wherein the teeth are located around an entire periphery of the protrusion and around an entire inner periphery of the hole.

6. The golf club head of claim 1, wherein the connecting structure comprises a hole in the golf club head body and wherein the shaft engaging member comprises a protrusion that is received in the hole and extends into the golf club head body in a heel-to-toe direction, wherein the rotational locking structures comprise a plurality of complementary teeth on the protrusion and the connecting structure that engage each other to rotationally lock the shaft engaging member with the connecting structure, and wherein the teeth extend over a majority of a length of the protrusion.

7. The golf club head of claim 1, further comprising a releasable securing member engaged with the golf club head body, wherein the securing member engages the shaft engaging member to retain the shaft engaging member in connection with the golf club head body, and wherein the securing member is releasable to allow for the shaft engaging member to be disconnected and adjusted.

8. The golf club head of claim 1, wherein the golf club head body further comprises a perimeter weighting member extending rearward from the striking face and a rear cavity positioned behind the striking face and at least partially defined by the perimeter weighting member, wherein the connecting structure further comprises a first arm and a second arm extending from the perimeter weighting member over a portion of the rear cavity, wherein the first arm and the second arm both engage the shaft engaging member to secure the shaft engaging member to the golf club head body, and wherein the rotational locking structure of the connecting structure is located on the first arm and the second arm.

9. The golf club head of claim 1, wherein the shaft engaging member is configured to be engaged with the connecting structure in a plurality of rotational positions with respect to the golf club head body, wherein the loft angle of the golf club head in each of the plurality of positions is different.

10. A golf club head comprising: a golf club head body having a striking face configured for striking a ball, the golf club head body having a connecting structure; a shaft engaging member engaged with the connecting structure of the golf club head body, wherein the shaft engaging member is configured to be engaged with a golf club shaft to connect the shaft to the golf club head body, the shaft engaging member comprising a first portion and a second portion that are angled with respect to each other, wherein the first portion extends upward and away from the golf club head body and the second portion is engaged with the connecting structure and extends into the golf club head body in a heel-to-toe direction; and a shroud engaged with at least one of the golf club head body and the shaft engaging member and extending between the golf club head body and the shaft engaging member to at least partially cover the gap and the connecting structure, wherein the shroud receives at least a portion of the first portion of the shaft engaging member therein, wherein the connecting structure and the second portion of the shaft engaging member have complementary rotational locking structures to rotationally lock the shaft engaging member with the connecting structure, and wherein the rotational locking structure is adjustable, such that the second portion of the shaft engaging member is configured to be engaged with the connecting structure in at least a first rotational position and a second rotational position with respect to the golf club head body, wherein a loft angle of the golf club head in the first position is different from the loft angle of the golf club head in the second position.

11. The golf club head of claim 10, wherein the connecting structure comprises a hole in the golf club head body and wherein the second portion of the shaft engaging member comprises a protrusion that is received in the hole and extends into the golf club head body in the heel-to-toe direction, wherein the rotational locking structures comprise a plurality of complementary teeth on the protrusion and the hole that engage each other to rotationally lock the shaft engaging member with the connecting structure.

12. The golf club head of claim 11, wherein the protrusion has a gear portion occupying a portion of a length of the protrusion proximate a heel edge of the golf club head body, wherein the teeth on the protrusion are located on the gear portion.

13. The golf club head of claim 11, wherein the teeth are located around an entire periphery of the protrusion and around an entire inner periphery of the hole.

14. The golf club head of claim 10, wherein the connecting structure comprises a hole in the golf club head body and wherein the second portion of the shaft engaging member comprises a protrusion that is received in the hole and extends into the golf club head body in the heel-to-toe direction, wherein the rotational locking structures comprise a plurality of complementary teeth on the protrusion and the connecting structure that engage each other to rotationally lock the shaft engaging member with the connecting structure, and wherein the teeth extend over a majority of a length of the protrusion.

15. The golf club head of claim 10, wherein the golf club head body further comprises a perimeter weighting member extending rearward from the striking face and a rear cavity positioned behind the striking face and at least partially defined by the perimeter weighting member, wherein the connecting structure further comprises a first arm and a second arm extending from the perimeter weighting member over a portion of the rear cavity, wherein the first arm and the second arm both engage the second portion of the shaft engaging member to secure the shaft engaging member to the golf club head body, and wherein the rotational locking structure of the connecting structure is located on the first arm and the second arm.

16. The golf club head of claim 10, wherein the second portion of the shaft engaging member is configured to be engaged with the connecting structure in a plurality of rotational positions with respect to the golf club head body, wherein the loft angle of the golf club head in each of the plurality of positions is different, and wherein the connecting structure of the golf club head body is releasable to allow for disconnection and adjustment of the shaft engaging member.

17. A golf club head comprising: a golf club head body having a striking face configured for striking a ball, the golf club head body having a connecting structure comprising a hole extending into the golf club head body; a shaft engaging member comprising a protrusion and a leg that is angled with respect to the protrusion, wherein the shaft engaging member is engaged with the connecting structure of the golf club head body such that the protrusion is received in the hole and extends into the golf club head body in a heel-to-toe direction and the leg extends upward and away from the golf club head body, wherein the shaft engaging member is configured to be engaged with a golf club shaft to connect the shaft to the golf club head body; and a shroud engaged with at least one of the golf club head body and the shaft engaging member and extending between the golf club head body and the shaft engaging member to at least partially cover the gap and the connecting structure, wherein the shroud receives at least a portion of the first portion of the shaft engaging member therein, wherein the connecting structure and the protrusion have a plurality of complementary teeth that engage each other to rotationally lock the protrusion with the connecting structure, and wherein the protrusion is configured to be engaged with the connecting structure in at least a first rotational position and a second rotational position with respect to the golf club head body, wherein a loft angle of the golf club head in the first position is different from the loft angle of the golf club head in the second position.

18. The golf club head of claim 17, wherein the protrusion has a gear portion occupying a portion of a length of the protrusion proximate a heel edge of the golf club head body, wherein the teeth on the protrusion are located on the gear portion.

19. The golf club head of claim 17, wherein the teeth are located around an entire periphery of the protrusion and around an entire inner periphery of the hole.

20. The golf club head of claim 17, wherein the protrusion is configured to be engaged with the connecting structure in a plurality of rotational positions with respect to the golf club head body, wherein the loft angle of the golf club head in each of the plurality of positions is different.

21. A golf club head comprising: a golf club head body having a striking face configured for striking a ball, the golf club head body having a connecting structure comprising a hole extending into the golf club head body; a shaft engaging member engaged with the connecting structure of the golf club head body, wherein the shaft engaging member is configured to be engaged with a golf club shaft to connect the shaft to the golf club head body, the shaft engaging member comprising a first portion and a second portion that are angled with respect to each other, wherein the first portion extends upward and away from the golf club head body and the second portion is received in the hole and extends into the golf club head body in a heel-to-toe direction, wherein a gap is defined between the first portion and a heel of the golf club head body; and a shroud engaged with at least one of the golf club head body and the shaft engaging member and extending between the golf club head body and the shaft engaging member to at least partially cover the gap and the connecting structure, wherein the shroud receives at least a portion of the first portion of the shaft engaging member therein, wherein the connecting structure and the second portion of the shaft engaging member have complementary rotational locking structures to rotationally lock the shaft engaging member with the connecting structure, and wherein the rotational locking structure is adjustable, such that the second portion of the shaft engaging member is configured to be engaged with the connecting structure in at least a first rotational position and a second rotational position with respect to the golf club head body, wherein a loft angle of the golf club head in the first position is different from the loft angle of the golf club head in the second position.

22. The golf club head of claim 21, wherein the shroud comprises a polymer shell.

23. The golf club head of claim 22, wherein the polymer shell extends around an entire periphery of the first portion of the shaft engaging member and has a flared portion that engages a heel end of the golf club head body.

24. The golf club head of claim 23, wherein the flared portion is substantially flush with one or more adjacent surfaces of the golf club head body.

25. The golf club head of claim 22, wherein the polymer shell has a first end with an opening receiving the first portion of the shaft engaging member therethrough and a second end with a flared opening that engages a heel end of the golf club head body, wherein the second portion extends through the flared opening to engage the connecting structure.

26. The golf club head of claim 21, wherein the golf club head body has a substantially flat heel surface, and wherein the connecting structure comprises a hole defined in the substantially flat heel surface and receiving a portion of the shaft engaging member therein.

27. The golf club head of claim 26, wherein the shroud engages the heel end of the golf club head body and completely covers the heel surface and the hole.

* * * * *